US011891895B1

(12) United States Patent
Sollami

(10) Patent No.: US 11,891,895 B1
(45) Date of Patent: Feb. 6, 2024

(54) BIT HOLDER WITH ANNULAR RINGS

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 17/146,992

(22) Filed: Jan. 12, 2021

Related U.S. Application Data

(63) Continuation-in-part of application No. 16/413,080, filed on May 15, 2019, which is a continuation-in-part of application No. 14/690,679, filed on Apr. 20, 2015, now Pat. No. 10,370,966.

(60) Provisional application No. 62/965,237, filed on Jan. 24, 2020, provisional application No. 61/983,291, filed on Apr. 23, 2014.

(51) Int. Cl.
*E21C 35/19* (2006.01)
*E21C 35/197* (2006.01)
*E21C 35/18* (2006.01)

(52) U.S. Cl.
CPC ..... *E21C 35/191* (2020.05); *E21C 35/197* (2013.01); *E21C 35/188* (2020.05); *E21C 35/19* (2013.01)

(58) Field of Classification Search
CPC .... E21C 35/191; E21C 35/197; E21C 35/188; E21C 35/19
See application file for complete search history.

(56) References Cited

U.S. PATENT DOCUMENTS

| | | | |
|---|---|---|---|
| 220,933 | A | 10/1879 | McGill |
| 2,382,947 | A | 7/1944 | Brozek |
| 2,783,799 | A | 3/1957 | Hart |
| 2,810,567 | A | 10/1957 | Kirkham |
| 3,342,531 | A | 9/1967 | Krekeler |
| 3,342,532 | A | 9/1967 | Krekeler |
| 3,397,012 | A | 8/1968 | Krekeler |
| 3,476,438 | A | 11/1969 | Bower, Jr. |
| 3,519,309 | A | 7/1970 | Engle |
| 3,833,264 | A | 9/1974 | Elders |
| 3,833,265 | A | 9/1974 | Elders |
| 3,865,437 | A | 2/1975 | Crosby |
| 3,997,011 | A | 12/1976 | Staroba |
| 4,084,856 | A | 4/1978 | Emmerich |
| 4,247,150 | A | 1/1981 | Wrulich et al. |
| RE30,807 | E | 12/1981 | Elders |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Abby J Flynn
*Assistant Examiner* — Michael A Goodwin
(74) *Attorney, Agent, or Firm* — Rockman Videbeck & O'Connor; Mercedes V. O'Connor

(57) ABSTRACT

A bit holder that includes a front body portion and a shank axially depending from the bottom of the front body portion. The shank of the bit holder includes at least one slot and at least one annular ring disposed partially or nearly circumferentially around the shank. The slotted shank of the bit holder and the at least one annular ring are radially compressible to achieve and maintain an interference fit when inserted into a bore of a base block.

31 Claims, 18 Drawing Sheets

(56) References Cited

U.S. PATENT DOCUMENTS 4,310,939 A 1/1982 Iijima
4,453,775 A 6/1984 Clemmow
4,478,298 A 10/1984 Hake
4,489,986 A 12/1984 Dziak
4,520,997 A 6/1985 Lorton
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,281,260 A 1/1994 Kumar et al.
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,541,006 A 7/1996 Conley
5,551,760 A 9/1996 Sollami
5,607,206 A 3/1997 Siddle
5,628,549 A 5/1997 Ritchey
5,647,641 A 7/1997 Sulosky et al.
5,720,528 A 2/1998 Ritchey
5,725,283 A 3/1998 O'Neill
5,738,415 A * 4/1998 Parrott ..... E21C 35/187 299/104
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,099,081 A * 8/2000 Warren ..... E21C 35/197 299/104
6,102,486 A 8/2000 Briese
6,176,552 B1 1/2001 Topka, Jr.
6,196,340 B1 3/2001 Jensen et al.
6,199,451 B1 3/2001 Sollami
6,220,376 B1 4/2001 Lundell
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,343,947 B1 * 3/2008 Sollami ..... E21C 35/197 144/241
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall

(56) References Cited

U.S. PATENT DOCUMENTS 8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
8,740,314 B2 6/2014 O'Neill
9,004,610 B2 4/2015 Erdmann et al.
9,028,008 B1 5/2015 Bookhamer
9,039,099 B2 5/2015 Sollami
9,316,061 B2 4/2016 Hall
9,518,464 B2 12/2016 Sollami
9,879,531 B2 1/2018 Sollami
9,909,416 B1 3/2018 Sollami
9,976,418 B2 5/2018 Sollami
9,988,903 B2 6/2018 Sollami
10,072,501 B2 9/2018 Sollami
10,105,870 B1 10/2018 Sollami
10,107,097 B1 10/2018 Sollami
10,107,098 B2 10/2018 Sollami
10,180,065 B1 1/2019 Sollami
10,260,342 B1 4/2019 Sollami
10,323,515 B1 6/2019 Sollami
10,337,324 B2 7/2019 Sollami
10,370,966 B1 8/2019 Sollami
10,385,689 B1 8/2019 Sollami
10,415,386 B1 9/2019 Sollami
10,502,056 B2 12/2019 Sollami
10,947,844 B1 3/2021 Sollami
10,954,785 B2 3/2021 Sollami
2002/0063467 A1 5/2002 Taitt
2002/0074850 A1 6/2002 Montgomery, Jr.
2002/0074851 A1 6/2002 Montgomery, Jr.
2002/0109395 A1* 8/2002 Sollami ..... E21C 35/197 299/106
2002/0167216 A1 11/2002 Sollami
2002/0192025 A1 12/2002 Johnson
2003/0015907 A1 1/2003 Sollami
2003/0047985 A1 3/2003 Stiffler
2003/0052530 A1 3/2003 Sollami
2003/0122414 A1 7/2003 Sollami
2003/0209366 A1 11/2003 McAlvain
2004/0004389 A1 1/2004 Latham
2004/0026132 A1 2/2004 Hall et al.
2004/0174065 A1 9/2004 Sollami
2005/0173966 A1* 8/2005 Mouthaan ..... E21C 35/197 299/104
2005/0212345 A1 9/2005 Sleep et al.
2006/0071538 A1 4/2006 Sollami
2006/0186724 A1 8/2006 Stehney
2006/0261663 A1 11/2006 Sollami
2007/0013224 A1 1/2007 Stehney
2007/0040442 A1 2/2007 Weaver
2007/0052279 A1 3/2007 Sollami
2008/0035386 A1 2/2008 Hall et al.
2008/0036276 A1 2/2008 Hall et al.
2008/0036283 A1 2/2008 Hall et al.
2008/0100124 A1 5/2008 Hall et al.
2008/0145686 A1 6/2008 Mirchandani
2008/0164747 A1 7/2008 Weaver et al.
2008/0284234 A1 11/2008 Hall et al.
2009/0146491 A1 6/2009 Fader et al.
2009/0160238 A1 6/2009 Hall et al.
2009/0184564 A1 7/2009 Brady
2009/0256413 A1 10/2009 Majagi
2009/0261646 A1 10/2009 Ritchie et al.
2009/0284069 A1* 11/2009 Watson ..... E21C 35/197 299/10
2010/0045094 A1 2/2010 Sollami
2010/0244545 A1 9/2010 Hall
2010/0253130 A1 10/2010 Sollami
2010/0320003 A1 12/2010 Sollami
2010/0320829 A1 12/2010 Sollami
2011/0006588 A1 1/2011 Monyak et al.
2011/0089747 A1 4/2011 Helsel
2011/0175430 A1 7/2011 Heiderich et al.
2011/0204703 A1 8/2011 Sollami
2011/0254350 A1 10/2011 Hall
2011/0314614 A1 12/2011 Barnhart et al.
2012/0001475 A1 1/2012 Dubay et al.
2012/0027514 A1 2/2012 Hall
2012/0056465 A1 3/2012 Gerer et al.
2012/0068527 A1* 3/2012 Erdmann ..... B28D 1/188 299/106
2012/0104830 A1 5/2012 Monyak et al.
2012/0181845 A1 7/2012 Sollami
2012/0242136 A1 9/2012 Ojanen
2012/0248663 A1 10/2012 Hall
2012/0261977 A1 10/2012 Hall
2012/0280559 A1 11/2012 Watson
2012/0286559 A1 11/2012 Sollami
2012/0319454 A1 12/2012 Swope
2013/0169022 A1* 7/2013 Monyak ..... E21C 35/197 299/79.1
2013/0169023 A1* 7/2013 Monyak ..... E21C 35/197 299/104
2013/0181501 A1 7/2013 Hall et al.
2013/0199693 A1 8/2013 Tank et al.
2013/0307316 A1 11/2013 Roetsch et al.
2014/0035346 A1 2/2014 Fundakowski et al.
2014/0110991 A1 4/2014 Sollami
2014/0232172 A1 8/2014 Roth et al.
2014/0262541 A1 9/2014 Parsana et al.
2014/0326516 A1 11/2014 Haugvaldstad
2015/0028656 A1* 1/2015 Sollami ..... E21C 35/18 299/79.1
2015/0035343 A1 2/2015 Ojanen
2015/0137579 A1 5/2015 Lachmann et al.
2015/0198040 A1 7/2015 Voitic et al.
2015/0240634 A1 8/2015 Sollami
2015/0285074 A1 10/2015 Sollami
2015/0292325 A1 10/2015 Sollami
2015/0300166 A1 10/2015 Ries et al.
2015/0308488 A1 10/2015 Kahl
2015/0315910 A1 11/2015 Sollami
2015/0354285 A1 12/2015 Hall
2016/0102550 A1* 4/2016 Paros ..... E21C 35/197 299/113
2016/0194956 A1* 7/2016 Sollami ..... E21C 35/19 299/105
2016/0229084 A1 8/2016 Lehnert
2016/0237818 A1 8/2016 Weber et al.
2017/0001292 A1 1/2017 Harrison
2017/0089198 A1 3/2017 Sollami
2017/0101867 A1 4/2017 Hall et al.
2017/0342831 A1 11/2017 Weber et al.
2018/0003050 A1* 1/2018 Sollami ..... E21C 35/19
2020/0157890 A1 5/2020 Cuillier De Maindreville et al.

FOREIGN PATENT DOCUMENTS

DE 202012100353 6/2013
DE 102015121953 7/2016
DE 102016118658 3/2017
EP 0997610 A1 * 5/2000 ..... E21C 35/188
EP 3214261 9/2017
GB 1114156 5/1968
GB 1218308 1/1971
GB 2010356 6/1979
GB 2483157 2/2012
GB 2534370 7/2016
WO 2008105915 A2 9/2008
WO 2008105915 A3 9/2008
WO 2009006612 1/2009

* cited by examiner

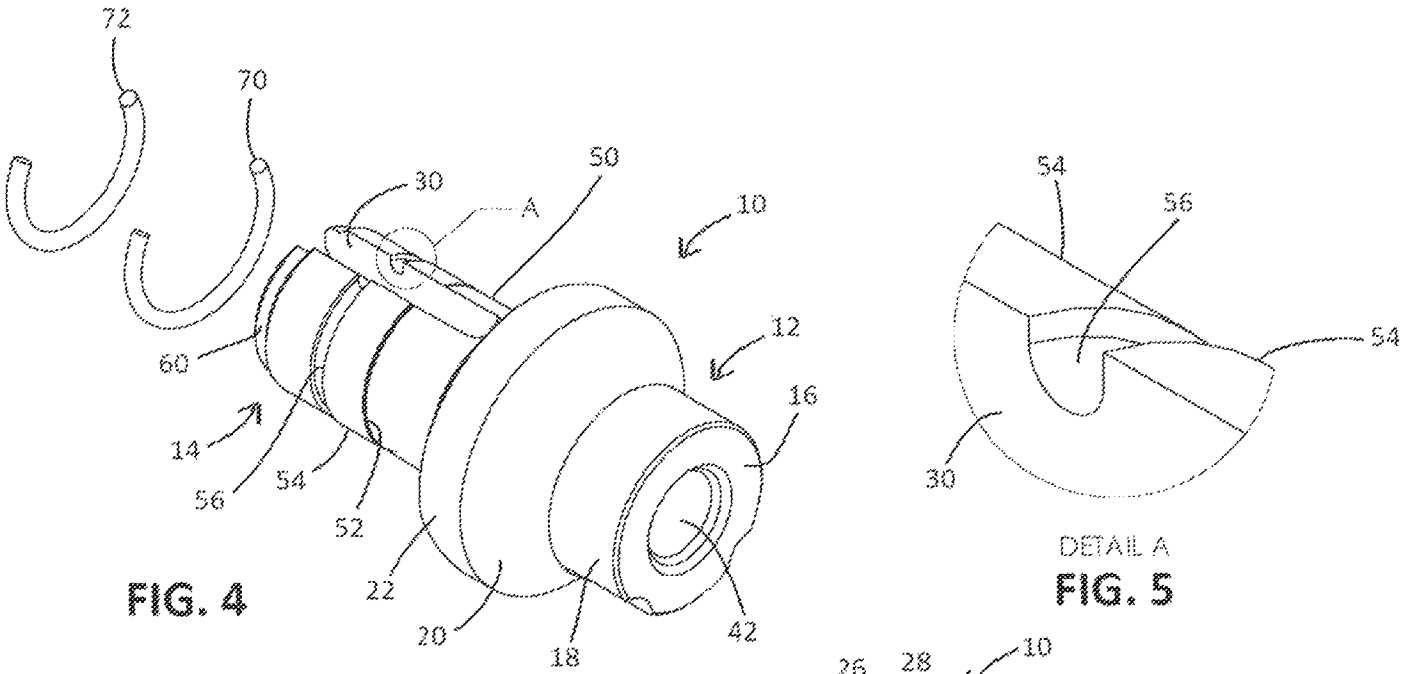
FIG. 4
DETAIL A
FIG. 5
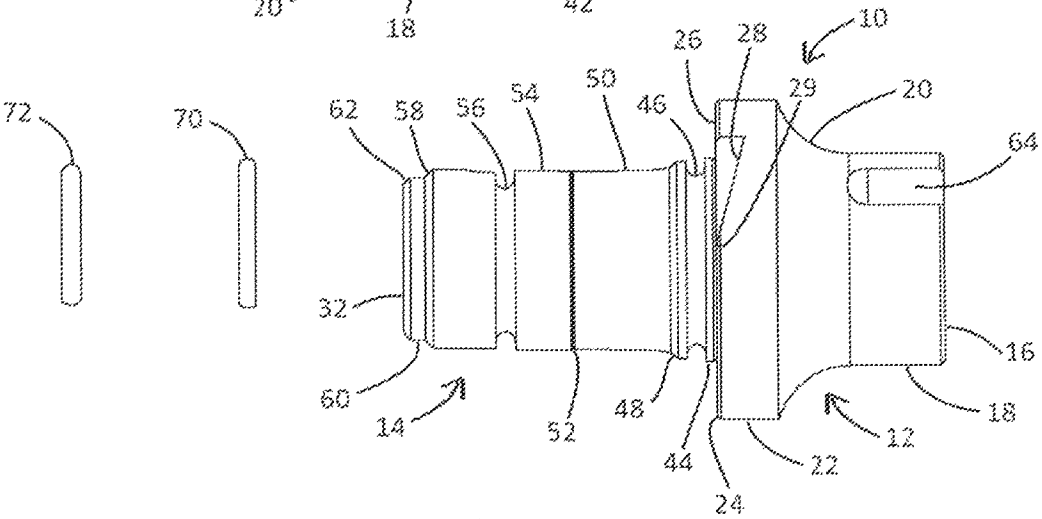
FIG. 6

SECTION B-B

SECTION C-C

SECTION L-L

BIT HOLDER WITH ANNULAR RINGS

CROSS-REFERENCE TO RELATED APPLICATION(S)

This application claims priority and is a continuation-in-part of U.S. Provisional Application No. 62/965,237, filed Jan. 24, 2020, claims priority to and is a continuation-in-part of U.S. Provisional Application No. 61/983,291, filed Apr. 23, 2014, claims priority to and is a continuation-in-part of U.S. Non-provisional application Ser. No. 14/690,679, filed Apr. 20, 2015, now U.S. Pat. No. 10,370,966, issued Aug. 6, 2019, and claims priority to and is a continuation-in-part of U.S. Non-provisional application Ser. No. 16/413,080, filed May 15, 2019, to the extent allowed by law and the contents of which are incorporated herein by reference in their entireties.

TECHNICAL FIELD

This disclosure relates to bit assemblies for road milling, mining and trenching machines and, more particularly, to bit holders with at least one annular ring.

BACKGROUND

Road milling, mining, and trenching equipment utilizes bits and/or picks traditionally set in a bit assembly. Bit assemblies can include a bit and/or pick retained within a bore in a base block. Bit assemblies can also include a bit and/or pick retained by a bit holder and the bit holder retained within a bore in a base block. A plurality of the bit assemblies are mounted on the outside of a rotatable drum, typically in a V-shaped or spiral configuration. A plurality of the bit assemblies can also be mounted on an endless chain and plate configurations. The combinations of bit assemblies have been utilized to remove material from the terra firma, such as degrading the surface of the earth, minerals, cement, concrete, macadam or asphalt pavement. Individual bits and/or picks, bit holders, and base blocks may wear down or break over time due to the harsh road degrading environment. Additionally, the forces and vibrations exerted on the bit assemblies may cause the bit holder to wear away the bore in the base block. As a result, the diameter of the bore of the base block increases over time, decreasing the interference contact between the bit holder and the bore of the base block, thereby damaging the bit holder or base block and requiring replacement of the bit holder or base block long before the standard minimum lifetime required by the industry.

To prolong the life of the bit assembly, and the bit holder and/or the base block, a bit holder comprising a slotted shank and two annular rings partially or nearly circumferentially disposed around the shank is provided to form and maintain the interference contact between the bore of the base block initially and even as the diameter of the bore of the base block increases from use. The service life of the bit holder and base block are substantially increased due to the bore wear compensation provided by the annular rings and the slotted shank of the bit holder.

SUMMARY

This disclosure relates generally to bit assemblies for road milling, mining, and trenching equipment. One implementation of the teachings herein is a bit holder that includes a body portion; a generally cylindrical hollow shank axially depending from a bottom of the body portion, the shank including: a first annular groove adjacent the bottom of the body portion; and a second annular groove adjacent a distal end of the shank.

In another implementations of the teachings herein is a combination bit holder and base block that includes a base block including: a base mounting portion including a base surface; and a device receiving portion integrally extending from the base mounting portion opposite the base surface, the device receiving portion comprising a bore extending from a front face of the device receiving portion to a rear face of the device receiving portion; and a bit holder including: a body portion; a generally cylindrical hollow shank axially depending from a bottom of the body portion, the shank including: a first annular groove adjacent the bottom of the body portion; and a second annular groove adjacent a distal end of the shank.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

FIG. 4 is an exploded perspective view of the first embodiment of the bit holder and the first embodiment of the two annular rings, and showing Detail A, in accordance with implementations of this disclosure;

FIG. 5 is a detail view of Detail A of the first embodiment of the bit holder of FIG. 4, in accordance with implementations of this disclosure;

FIG. 6 is an exploded side elevation view of the first embodiment of the bit holder and the first embodiment of the two annular rings, in accordance with implementations of this disclosure;

DETAILED DESCRIPTION

Figure 2:
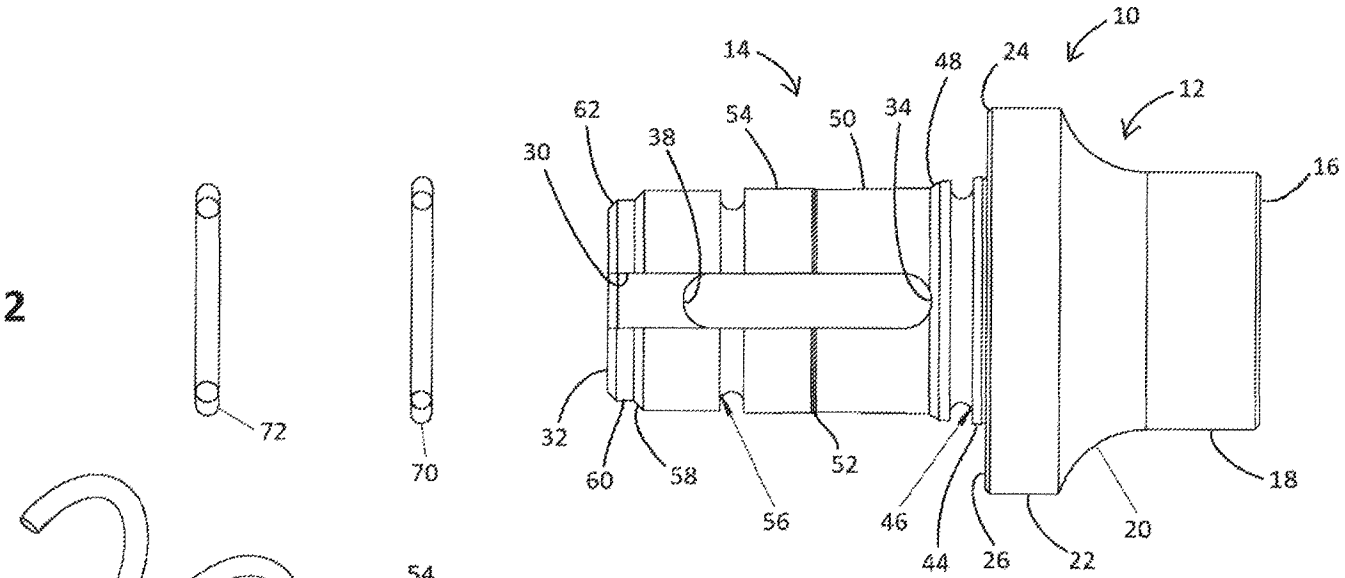
FIG. 2 is an exploded side elevational view of the first embodiment of the bit holder and the first embodiment of the two annular rings, in accordance with implementations of this disclosure.
Figure 1:
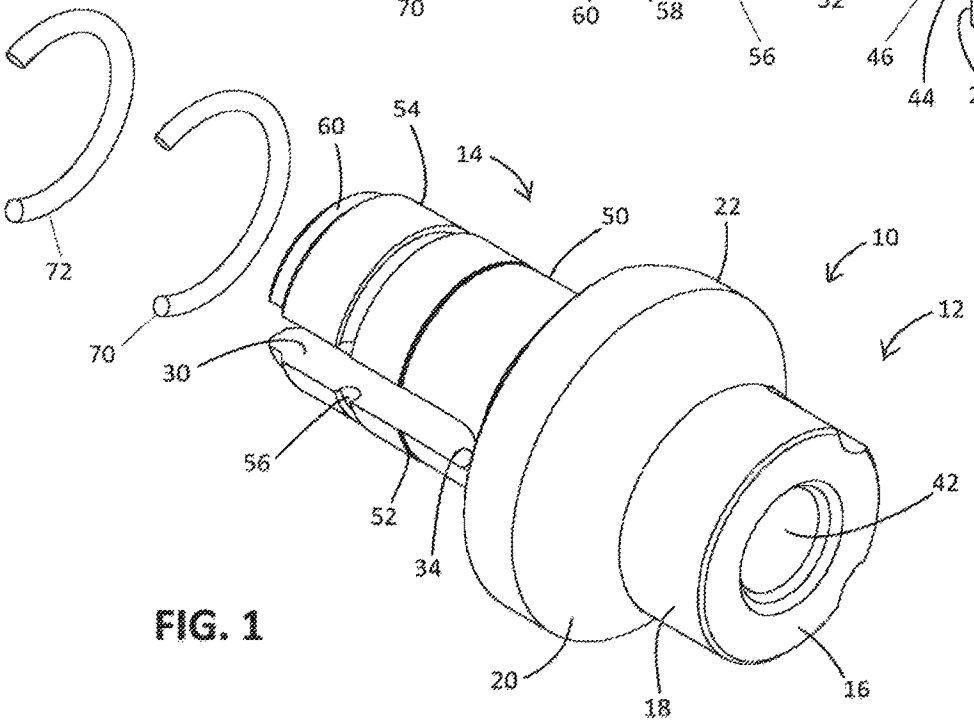
FIG. 1 is an exploded perspective view of a first embodiment of a bit holder and a first embodiment of two annular rings, in accordance with implementations of this disclosure.
Figure 3:
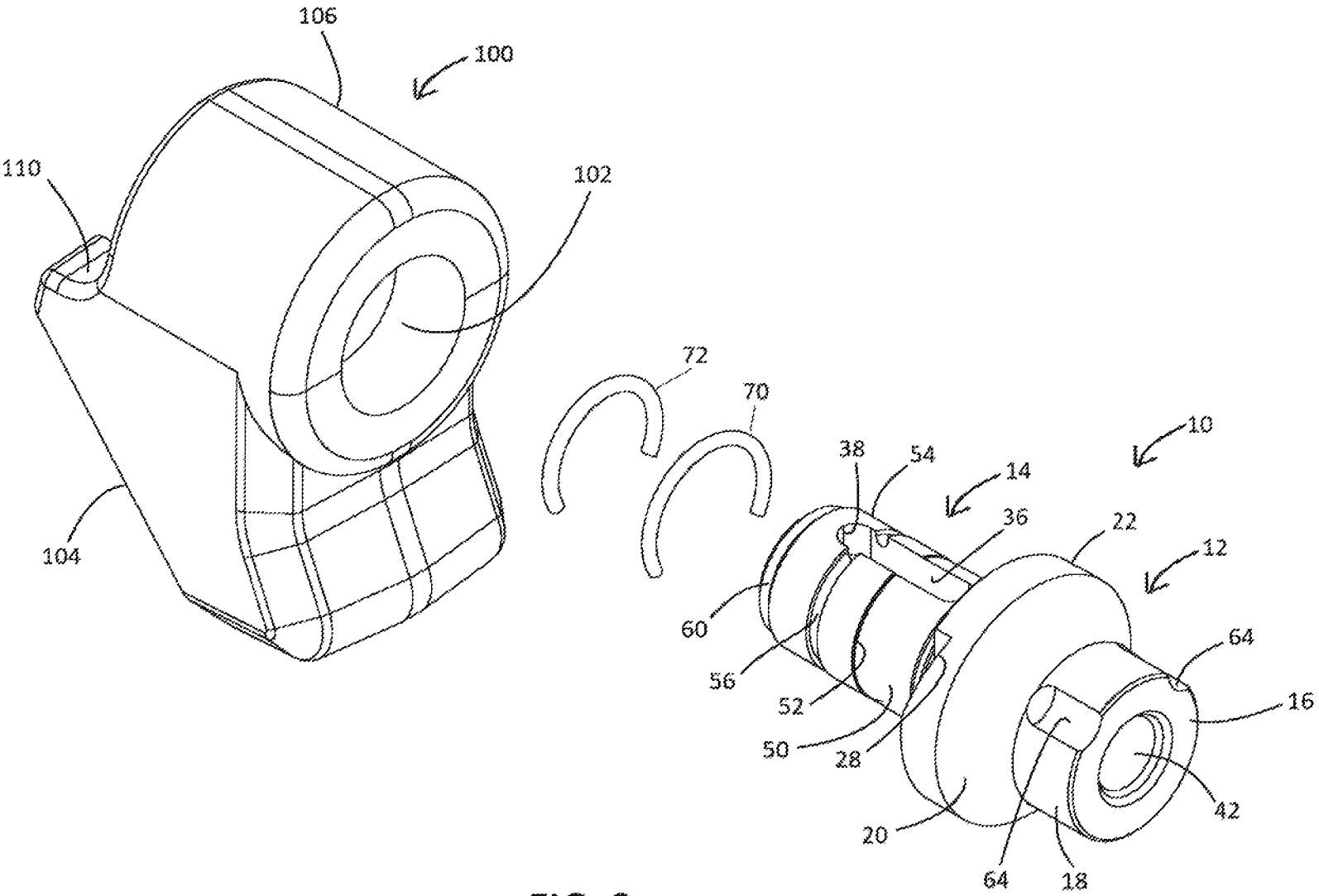
FIG. 3 is an exploded perspective view of the first embodiment of the bit holder, the first embodiment of the two annular rings, and a first embodiment of a base block, in accordance with implementations of this disclosure.
Figure 10:
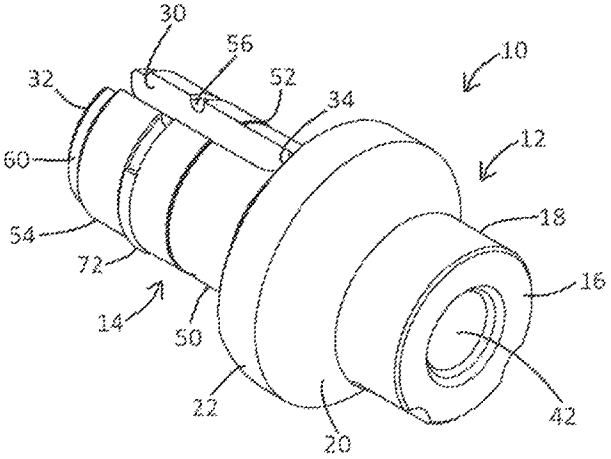
FIG. 10 is a perspective view of the first embodiment of the bit holder, shown with the first embodiment of the two annular rings disposed on the shank of the bit holder, in accordance with implementations of this disclosure.
Figure 11:
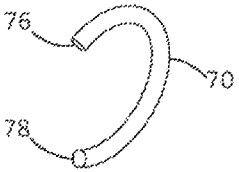
FIG. 11 is a perspective view of the first embodiment of the annular ring in accordance with implementations of this disclosure.
Figure 12:
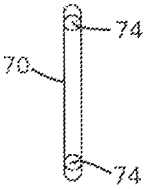
FIG. 12 is a front elevation view of the first embodiment of the annular ring in accordance with implementations of this disclosure.
Figure 13:
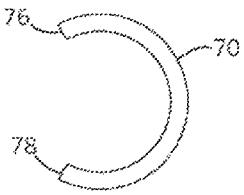
FIG. 13 is a side elevation view of the first embodiment of the annular ring in accordance with implementations of this disclosure.
Figure 7:
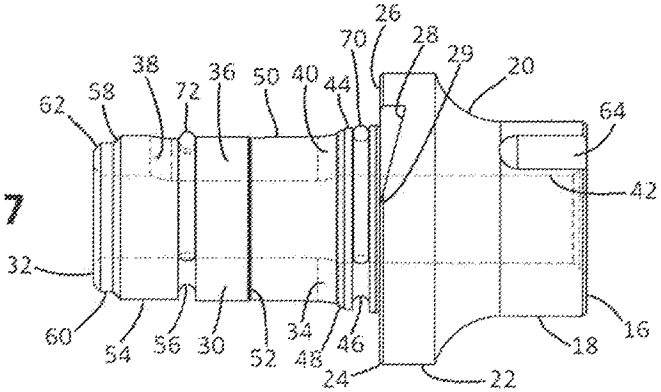
FIG. 7 is a right side elevation view of the first embodiment of the bit holder, shown with the first embodiment of the two annular rings disposed on a shank of the bit holder, showing invisible internal elements in dotted lines, in accordance with implementations of this disclosure.
Figure 8:
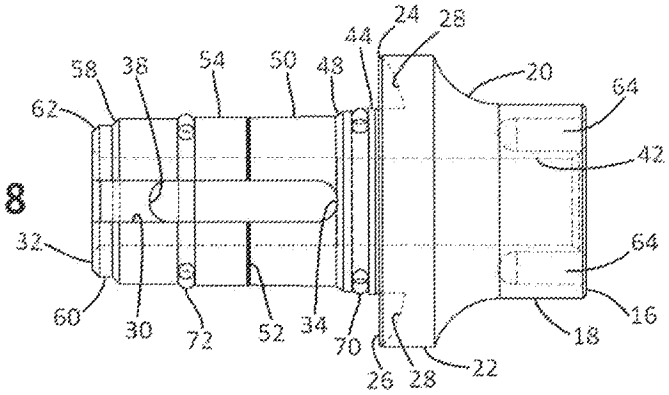
FIG. 8 is a top elevation view of the first embodiment of the bit holder, shown with the first embodiment of the two annular rings disposed on the shank of the bit holder, showing invisible internal elements in dotted lines, in accordance with implementations of this disclosure.
Figure 9:
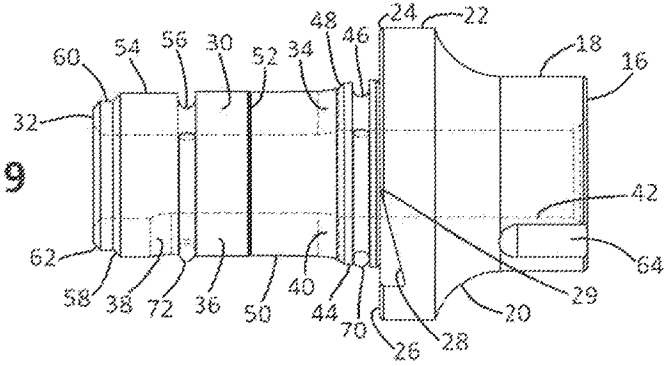
FIG. 9 is a left side elevation view of the first embodiment of the bit holder, shown with the first embodiment of the two annular rings disposed on the shank of the bit holder, showing invisible internal elements in dotted lines, in accordance with implementations of this disclosure.
Figure 17:
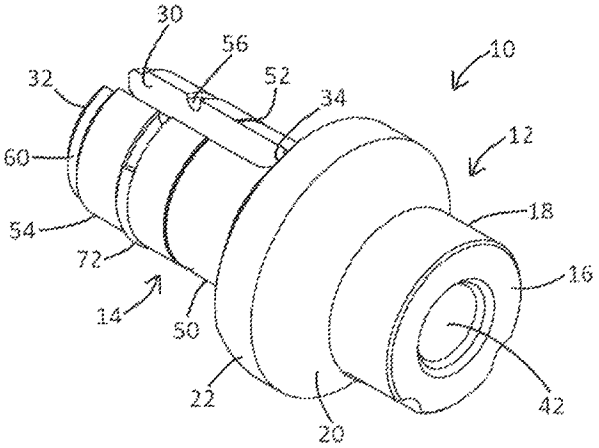
FIG. 17 is a perspective view of the first embodiment of the bit holder, shown with the first embodiment of the two annular rings disposed on the shank of the bit holder, in accordance with implementations of this disclosure.
Figure 18:
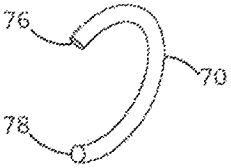
FIG. 18 is a perspective view of the first embodiment of the annular ring in accordance with implementations of this disclosure.
Figure 19:
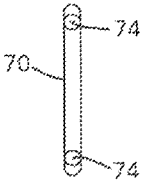
FIG. 19 is a front elevation view of the first embodiment of the annular ring in accordance with implementations of this disclosure.
Figure 20:
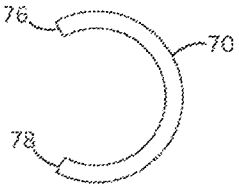
FIG. 20 is a side elevation view of the first embodiment of the annular ring in accordance with implementations of this disclosure.
Figure 14:
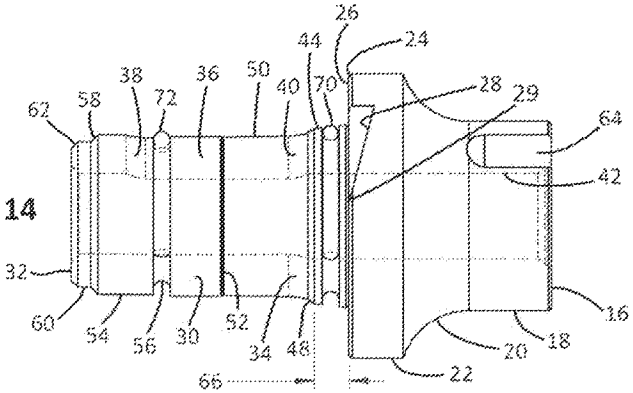
FIG. 14 is a right side elevation view of the first embodiment of the bit holder, shown with the first embodiment of the two annular rings disposed on the shank of the bit holder, showing invisible internal elements in dotted lines, in accordance with implementations of this disclosure.
Figure 15:
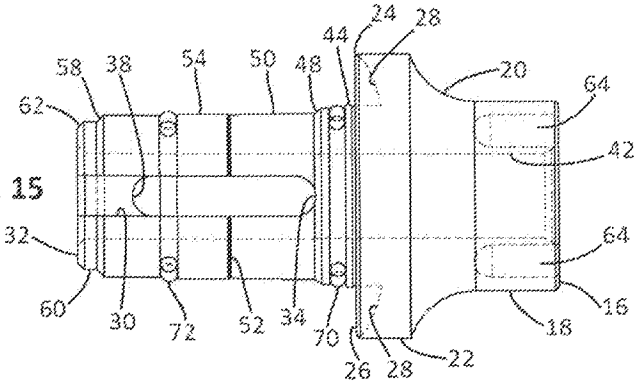
FIG. 15 is a top elevation view of the first embodiment of the bit holder, shown with the first embodiment of the two annular rings disposed on the shank of the bit holder, showing invisible internal elements in dotted lines, in accordance with implementations of this disclosure.
Figure 16:
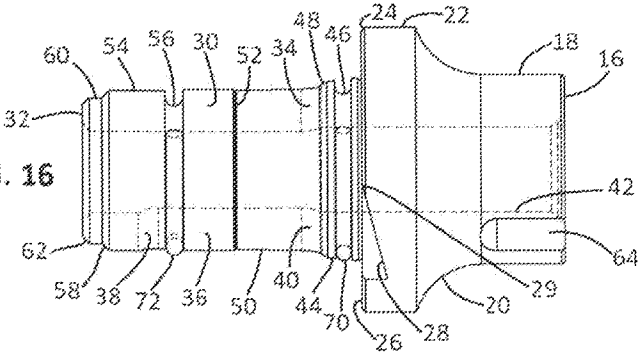
FIG. 16 is a left side elevation view of the first embodiment of the bit holder, shown with the first embodiment of the two annular rings disposed on the shank of the bit holder, showing invisible internal elements in dotted lines, in accordance with implementations of this disclosure.
Figure 21:
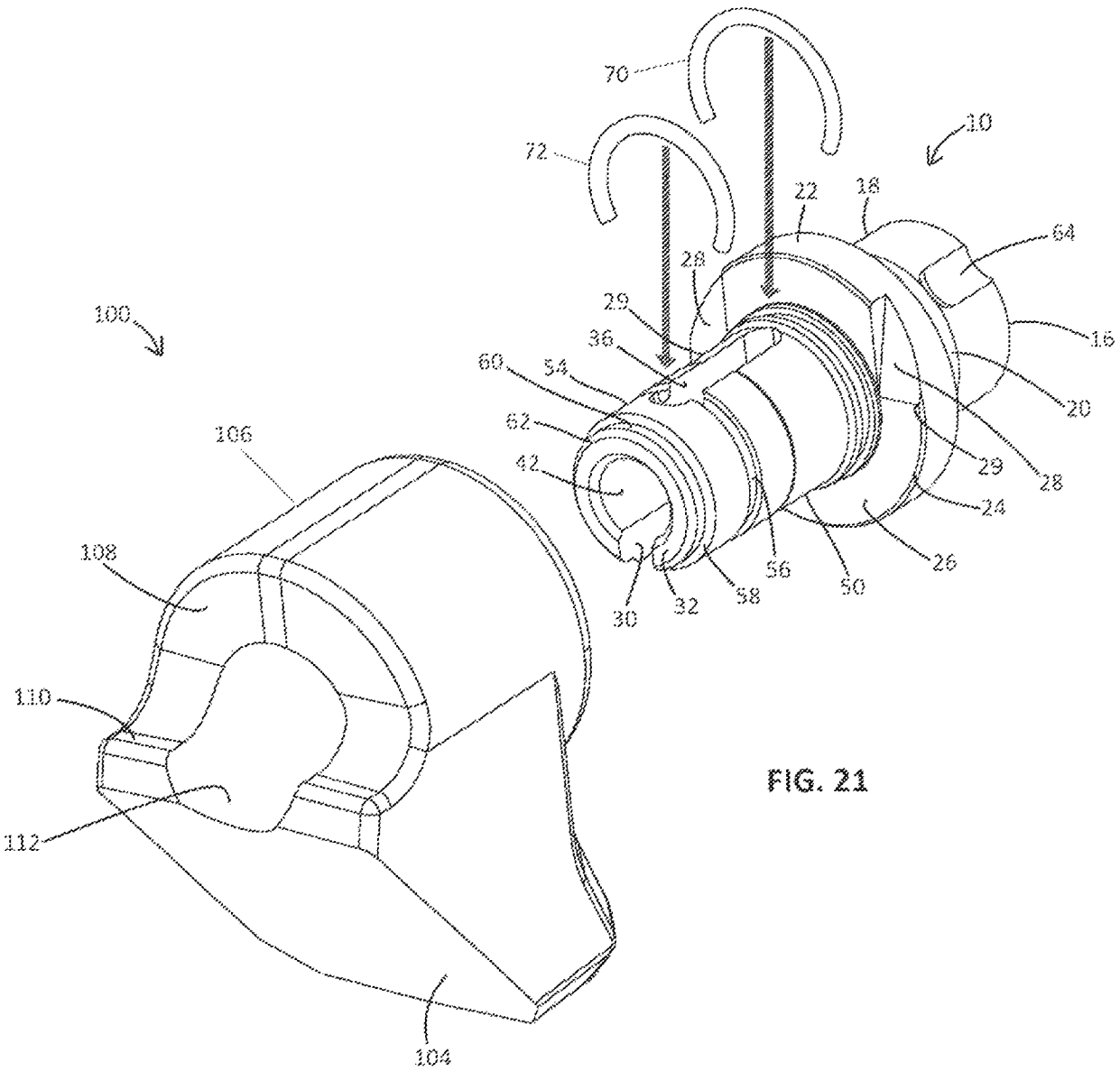
FIG. 21 is an exploded rear perspective view of the first embodiment of the bit holder, the first embodiment of the two annular rings, and the first embodiment of the base block, in accordance with implementations of this disclosure.
Figure 22:
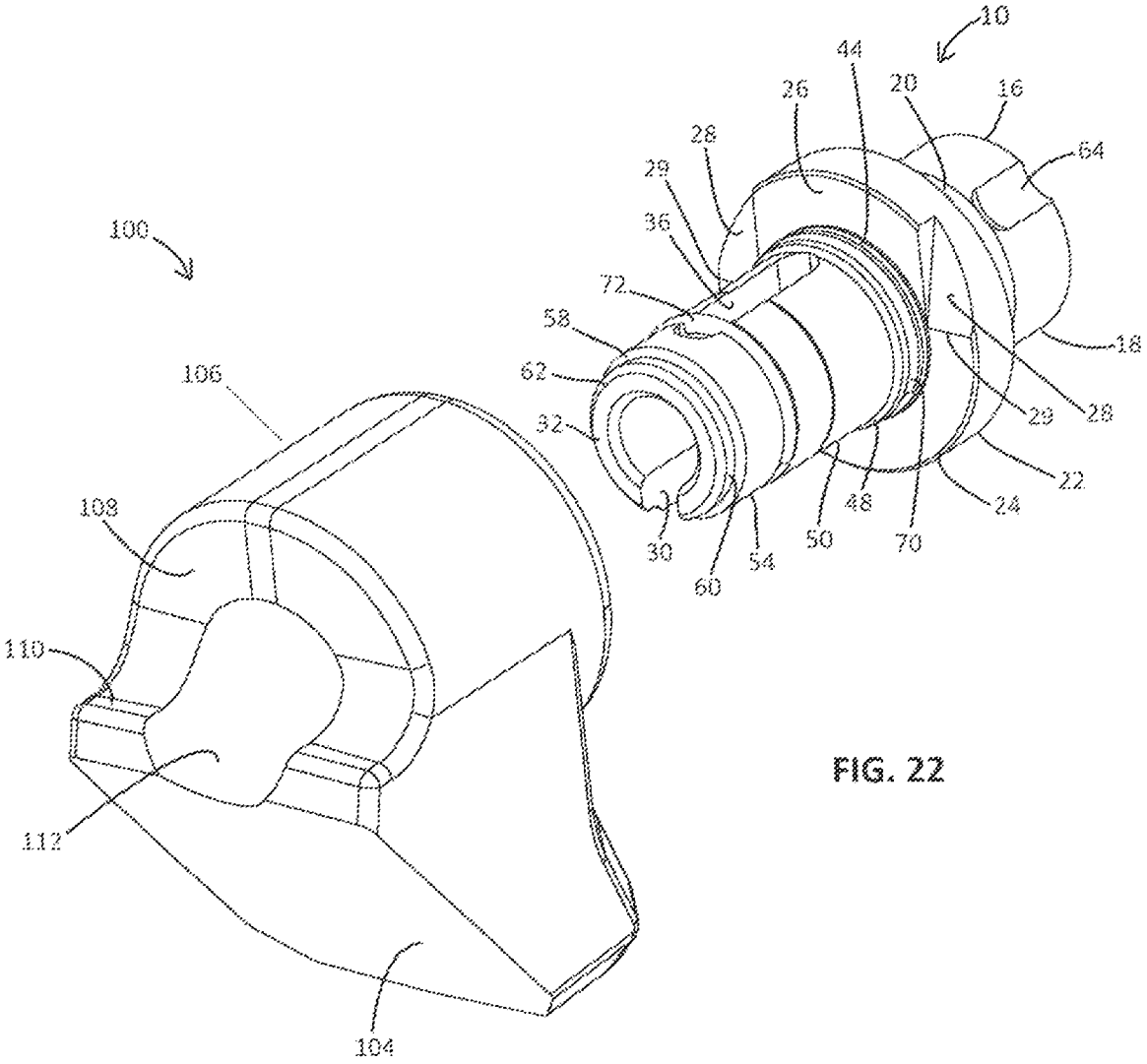
FIG. 22 is an exploded rear perspective view of the first embodiment of the bit holder, shown with the first embodiment of the two annular rings disposed on the shank of the bit holder, and the first embodiment of the base block, in accordance with implementations of this disclosure.
Figure 24:
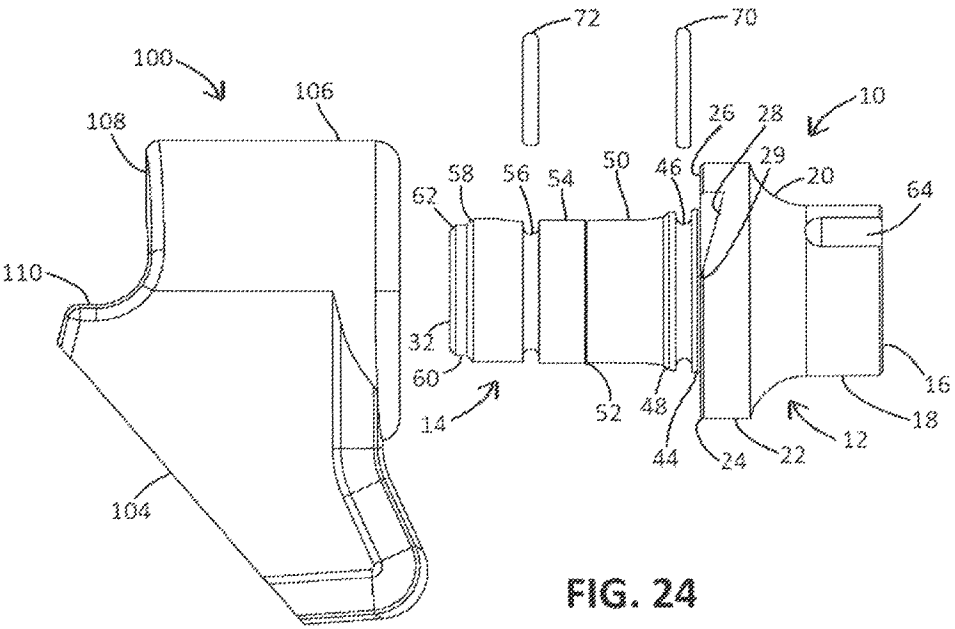
FIG. 24 is an exploded right side elevation view of the first embodiment of the bit holder, the first embodiment of the two annular rings, and the first embodiment of the base block, in accordance with implementations of this disclosure.
Figure 23:
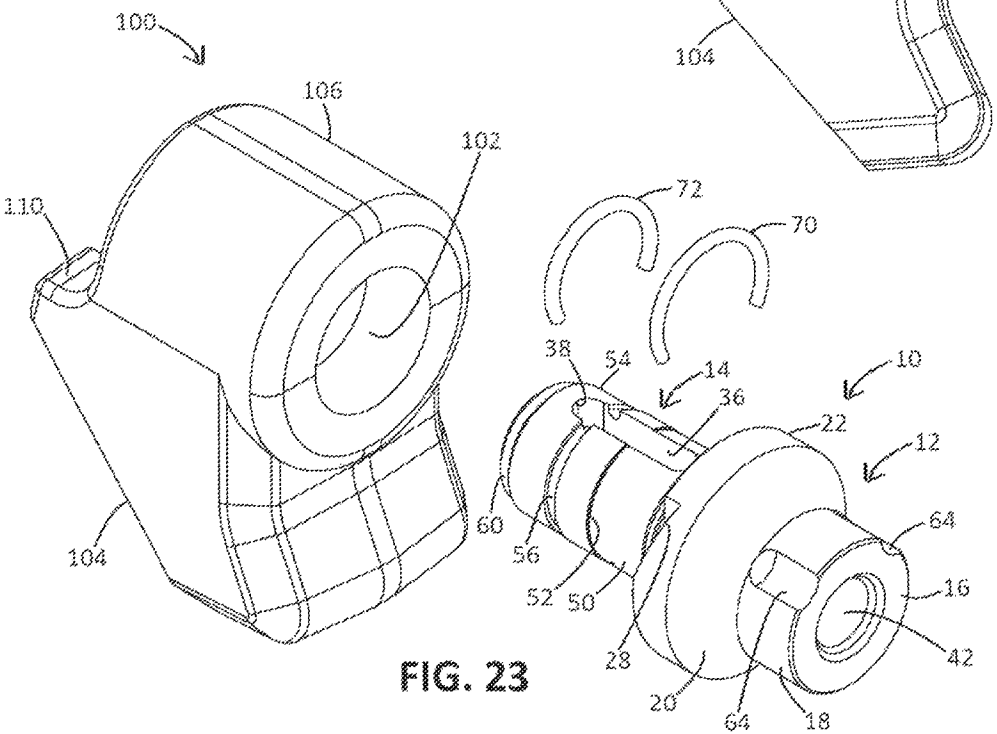
FIG. 23 is an exploded perspective view of the first embodiment of the bit holder, the first embodiment of the two annular rings, and the first embodiment of the base block, in accordance with implementations of this disclosure.
Figure 26:
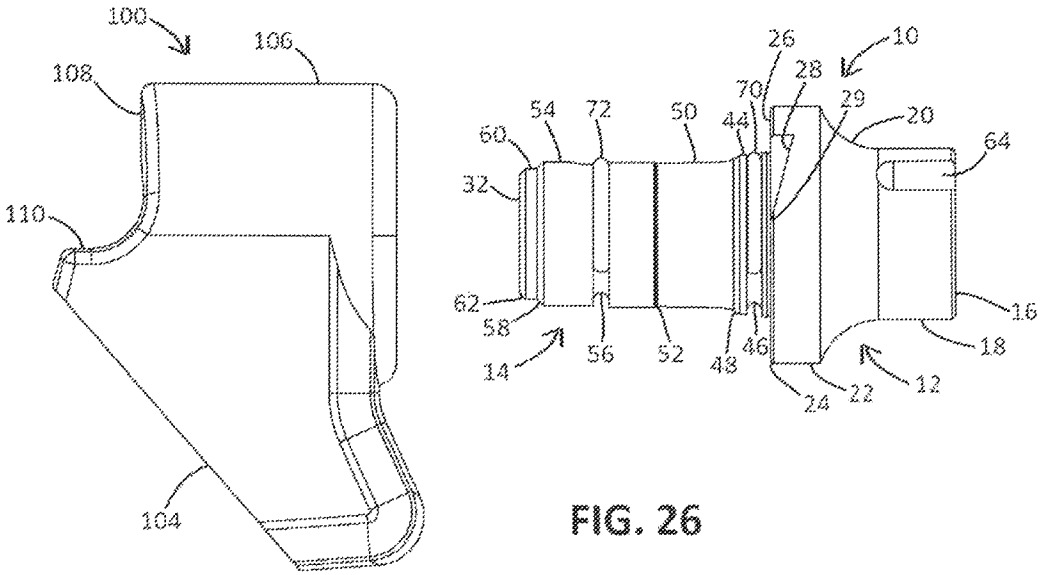
FIG. 26 is an exploded right side elevation view of the first embodiment of the bit holder, shown with the first embodiment of the two annular rings disposed on the shank of the bit holder, and the first embodiment of the base block, in accordance with implementations of this disclosure.
Figure 25:
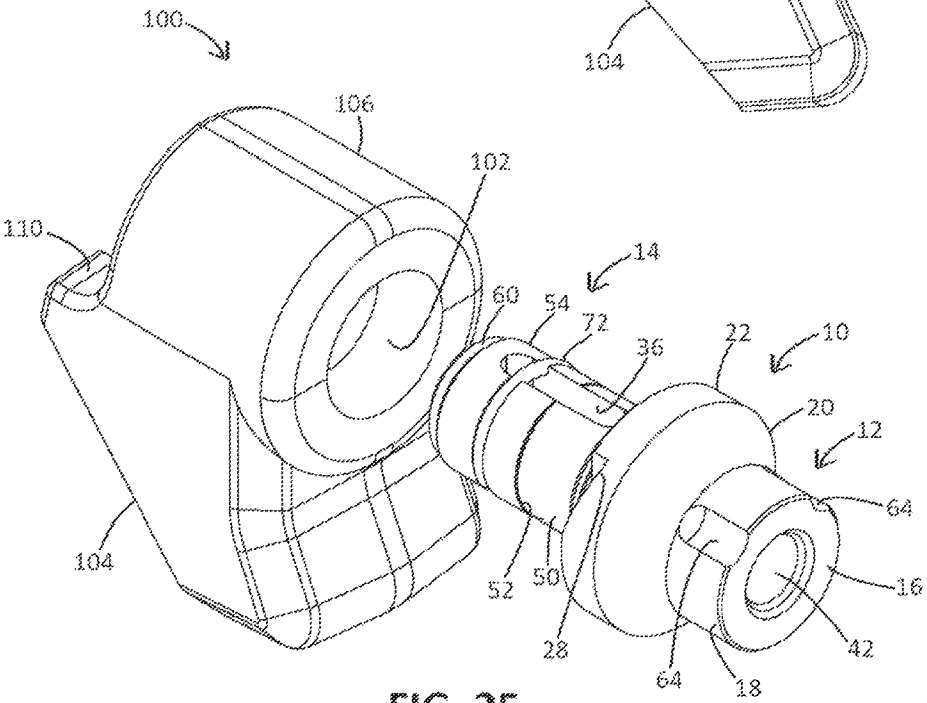
FIG. 25 is an exploded perspective view of the first embodiment of the bit holder, shown with the first embodiment of the two annular rings disposed on the shank of the bit holder, and the first embodiment of the base block, in accordance with implementations of this disclosure.
Figure 28:
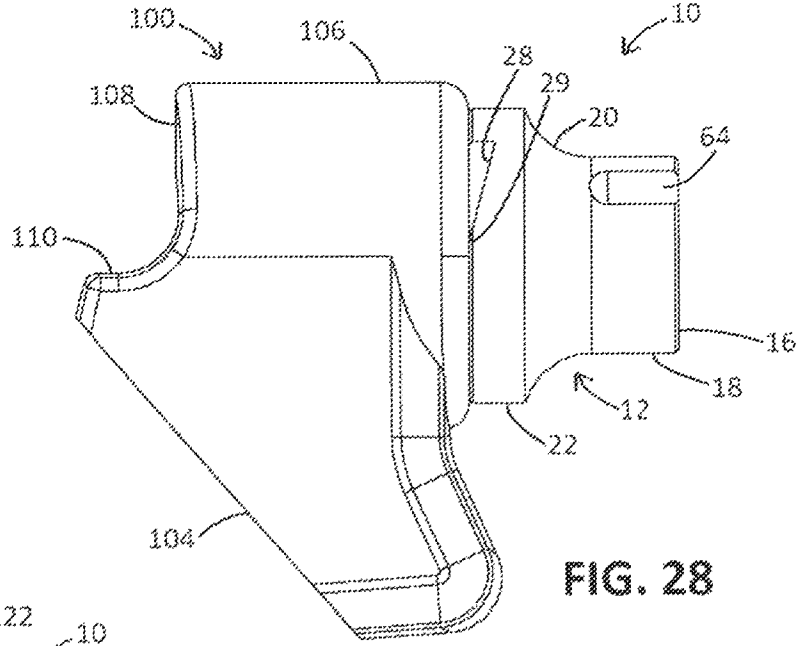
FIG. 28 is a right side elevation view of the first embodiment of the bit holder assembled in the first embodiment of the base block in accordance with implementations of this disclosure.
Figure 27:
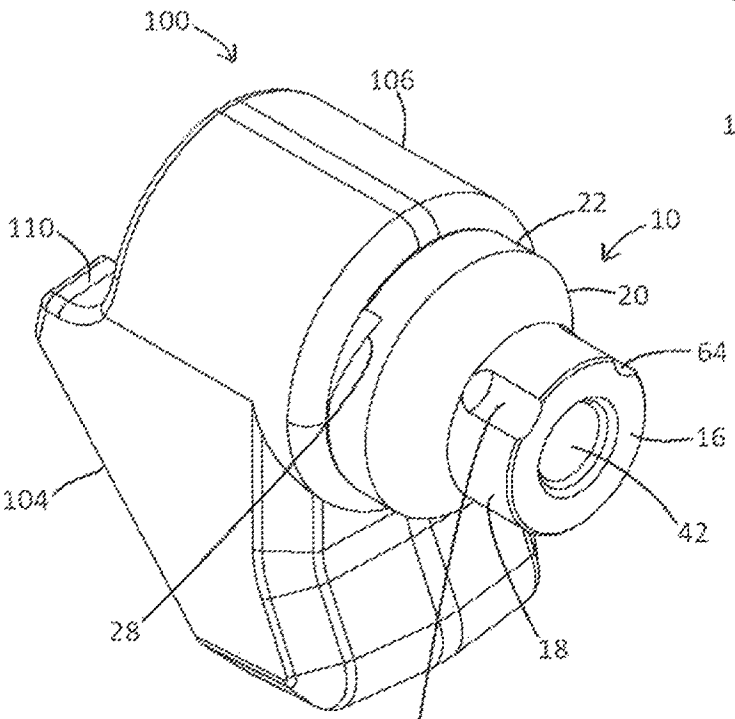
FIG. 27 is a perspective view of the first embodiment of the bit holder assembled in the first embodiment of the base block in accordance with implementations of this disclosure.

Referring to FIGS. 1-4, 6-10, 14-17, 21-32, and 65-72, a first embodiment of a bit holder 10 is shown. The bit holder 10, in this illustrated embodiment, is an approximately 2¾ inch generally standard length shank bit holder that comprises a "beefed up" bit holder body 12 and a generally cylindrical hollow shank 14 axially depending from a bottom of the bit holder body 12. This design of the bit holder can also be implemented successfully with various length shanks. The bit holder body 12, in this exemplary implementation of the first embodiment, is generally annular in shape and comprises a generally cylindrical upper body portion 18 axially extending from a top surface 16, such as a flat annular top surface. Subjacent the upper body portion 18 is a flared mediate portion 20, which in this embodiment includes a concave side surface that extends axially, downwardly, and radially outwardly to a generally cylindrical tire portion 22 axially extending from the mediate portion 20. A chamfer 24 (FIGS. 2, 6-9, 14-16, 21, 22, 24, 26, and 67) extends from a bottom of the tire portion 22 to a back flange 26, which may be flat and generally annular. The chamfer 24 provides, when the bit holder 10 is fully mounted in a first embodiment of a base block 100 (FIGS. 3, 21-32, and 65-72), a hollowed out area between the back flange 26 of the bit holder body 12 and a face of the base block 100 that provides a space in which an extraction tool (not shown) may be inserted and utilized to easily remove the bit holder 10 from the base block 100. A pair of notches 64-64, shown in FIGS. 3, 6-9, 14-16, 23-29, 31, 65-69, and 71, are formed into the bit holder body 12 and extend from the flat annular top surface 16 through the upper body portion 18, terminating at a point just within the flared mediate portion 20. The notches 64-64 provide access and leverage for a tool to extract, or knock out, a bit from the bit holder body 12.

The back flange 26 includes a pair of horizontal tapered cutouts 28-28 (FIGS. 3, 6-9, 14-16, 21-28, 31, 67, 68, and 71) generally perpendicular to the longitudinal axis of the bit holder 10, one on either side of the back flange 26. The tapered cutouts 28-28 each include a flat vertical inside surface parallel with each other and a flat tapered top surface. The outside edge of each top surface is arcuate in shape and follows the periphery of the tire portion 22. The interior border, or declining terminus 29, of each tapered cutout 28-28 may extend to a plane through the centerline of the bit holder 10, may not extend to a plane through the centerline of the bit holder 10, may extend beyond a plane through the centerline of the bit holder 10, and/or may be offset from each other. The tapered cutouts 28-28 are adapted to receive a pair of bifurcated fork tines that may be inserted between the base of the bit holder body 12 and the face of the first embodiment of the base block 100 into which the shank 12 of the bit holder 10 is inserted and retained by outward radial forces of the shank while in use. Other base block configurations can be used without deviating from the concept of this design.

The shank 14 includes an elongate first slot 30 extending from a distal end 32, such as a generally annular distal end, of the shank 14 axially upward or forward to an upper termination 34 near the upper or forward end of the shank 14. In this exemplary implementation, the shank 14 also includes an optional internally oriented second slot 36 located approximately 180 degrees around the annular shank 14 from the first slot 30. This second slot 36 is parallel to the first slot in this illustrated embodiment, and is an internal slot having a rearward termination 38 inwardly adjacent to the distal end 32 of the shank 14 and a forward termination 40 generally coinciding longitudinally and axially with the upper termination 34 of the first slot 30.

A central bore 42 axially extends from the top surface 16 of the bit holder 10 to the distal end 32 of the shank 14. The central bore 42 is adapted to receive the shank of a bit (not shown). The central bore 42 and the slots 30, 36 allow the generally C-shaped annular sidewall of the shank 14 to radially contract when the shank is mounted into a bore 102 (FIGS. 3, 21-23, 25, 32, 70, and 72) of the base block 100.

Depending from the back flange 26 of the bit holder body 12 is the generally cylindrical hollow shank 14. In a second embodiment of the bit holder, the top portion of the shank 14 can include an optional rounded junction (not shown) between the bit holder body 12 and the shank 14 which provides a stress relieving portion between the bit holder body 12 and the shank 14 of the bit holder, avoiding sharp corners and/or edges and which may provide an area for stress cracks to begin. An increased diameter first segment 44, which in this illustrated embodiment is tapered, axially depends from the bottom of the bit holder body 12 and includes a groove 46 adapted to receive an annular ring. Groove 46 includes the same profile seat, or inner diameter, for the bottom portion of the groove 46 as the inner diameter of the annular ring. The axial length 66 of the first segment 44 is a design feature of the bit holder 10 and is positioned in the tapered zone of a bore of the base block 100 to support radial deflection. The distal end of the increased diameter first segment 44 includes a tapered portion 48 that axially extends from the distal end of the increased diameter tapered first segment 44 to a decreased diameter generally cylindrical second segment 50. The decreased diameter generally cylindrical second segment 50 axially extends to stepped shoulder 52 disposed between the decreased diameter generally cylindrical second segment 50 and an increased diameter third segment 54. The stepped shoulder 52 increases, or steps up, as it axially extends from the decreased diameter generally cylindrical second segment 50 to the increased diameter third segment 54. The increased diameter third segment 54 includes a groove 56 (FIG. 5) adapted to receive an annular ring. Groove 56 includes the same profile seat, or inner diameter, for the bottom portion of the groove 56 as the inner diameter of the annular ring. A first tapered portion 58 axially extends from the distal end of the increased diameter third segment 54 to a decreased diameter generally cylindrical fourth segment A second tapered portion 62 axially extends from the distal end of the decreased diameter generally cylindrical fourth segment 60 to the distal end 32 of the shank 14. In other embodiments, the shank 14 may comprise different configurations, for example, the first segment 44, the second segment 50, the third segment 54, and/or the fourth segment 60 may comprises a generally cylindrical shape, an arcuate shape, an outward taper, an inward taper, a slight draw angle, or a slight draft angle. Also in other embodiments, the shank 14 can also be cylindrical or tapered towards or away from a central axis of the bit holder 10 from the distal end 32 to a forward end of the shank 14 and still have the two annular ring concept to achieve the same functional aspects.

Referring to FIGS. 3, 21-32, and 65-72, the first embodiment of the base block 100 is shown. Base block 100 includes a base surface 104 which may be flat or slightly concave to fit a drum or additional mounting plates thereon (not shown) on which a plurality of base blocks may be mounted, usually in chevron or spiral fashion. Outwardly of the mounting portion or base surface 104 of the base block 100, is a generally annular bit holder mounting portion 106, also called a device receiving portion or front end, having a central nominal 1½ inch diameter annular or generally cylindrical bore 102 positioned therethrough, which is generally positioned, in this illustrated embodiment, at between 30-60 degrees from the horizontal. The base block bore 102 includes a tapered section 103 axially extending from the front face of the device receiving portion 106 to a generally cylindrical section 105 that axially extends from the tapered section 103 to a rear 108 of the device receiving portion 106. The increased diameter first segment 44 and the annular ring 70 are positioned in the tapered section of the base block bore 102 and supports radial deflection. The annular bit holder mounting portion or device receiving portion 106 of the base block 100 is, in this illustrated embodiment, about 2½ inch in length and is configured to receive the shank 14 of the bit holder 10.

The base block 100 includes added space behind the device receiving portion 106. This added space provides additional access up to about ⅞ inch from the device receiving portion 106 for tools to remove or punch out either bits from the bit holder 10 annular or circular bore 42 or the bit holder 10 from the base block bore 102. The base block 100 includes a surface 110 opposite the base surface 104 that extends past the rear 108 of the device receiving portion 106. Surface 110 includes an extension of an arcuate segment 112 of the generally cylindrical section 105 of the base block bore 102.

Referring to FIGS. 1-4, 6-26, 30, and 32-36, a first embodiment of a c-shaped annular ring 70, 72 is shown. In this illustrated exemplary first embodiment, the c-shaped annular rings 70, 72 are a steel round wire round ring, including a round cross-section 74 taken at an angle to a longitudinal axis of the round wire round rings 70, 72, that extend from a first end 76 to a second end 78. In alternate embodiments, described below, the c-shaped annular rings can have various other shapes, such as square, hexagon, angular, etc. The outer profile of the annular rings of each embodiment match the base block bore 102 profile. Annular ring 70, in this illustrated embodiment, has a greater diameter than annular ring 72. Regardless of what annular ring designs are used, the c-shaped annular ring disposed in the groove 46 will have a larger diameter than the c-shaped annular ring disposed in groove 56.

To assemble the c-shaped annular rings 70, 72 with the bit holder 10 of the first embodiment, the first c-shaped annular ring 70 is disposed around/in groove 46 of the increased diameter tapered first segment 44 and the second c-shaped annular ring 72 of a smaller size or diameter is disposed around/in groove 56 of the increased diameter third segment 54, as shown in FIGS. 7-10, 14-17, 22, 25, 26, 30, and 32. When disposed around groove 46 and groove 56, the first end 76 and the second end 78 of annular rings 70, 72 are spatially oriented from each other, in this illustrated embodiment, such that annular rings 70, 72 do not extend completely around the circumference of the shank 14 in groove 46 and groove 56. The annular rings 70, 72 include exaggerated raised profiles, shown in FIG. 21, that provide additional interference that will compensate for bore wear in the tapered section 103 and the generally cylindrical section 105, respectively, of bore 102 of the base block 100. The shank 14 of the bit holder 10, including annular rings 70, 72, is inserted into the bore 102 of the base block 100 and forms a non-rotatable interference fit with the bore 102 of the base block 100. Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The purpose of adding the bore wear compensating features, such as the annular rings 70, 72, to the bit holder 10 is to provide a base block that has the same lifespan as the lifespan of the drum on which they're mounted, thereby increasing the lifespan of the drum itself.

Figure 30:
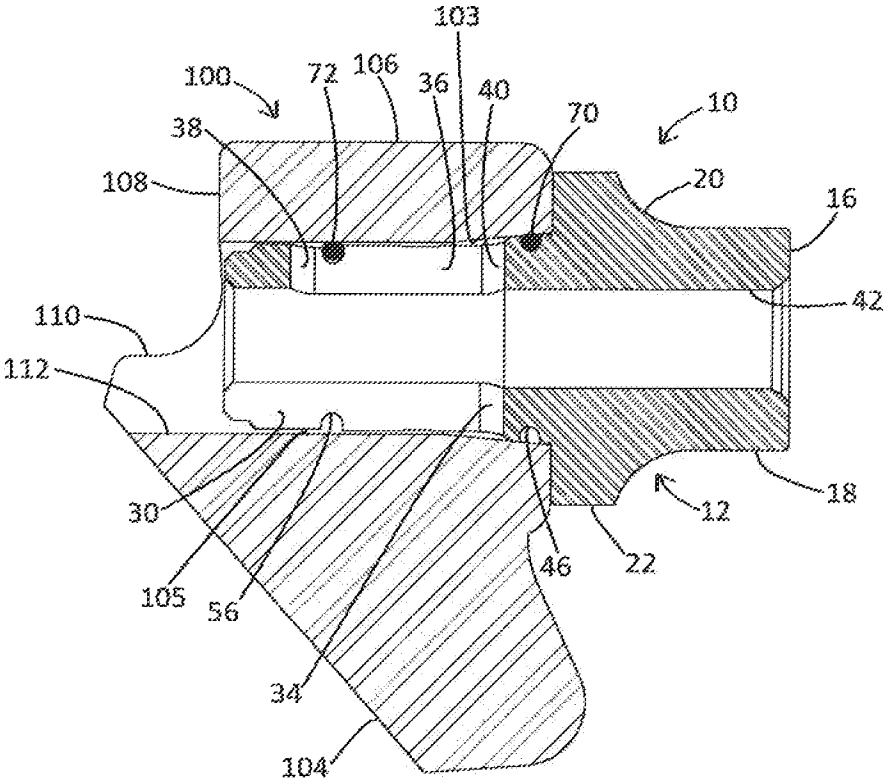
FIG. 30 is a cross-sectional view of the first embodiment of the bit holder, shown with the first embodiment of the two annular rings disposed on the shank of the bit holder, assembled in the first embodiment of the base block, taken along line B-B of FIG. 29, in accordance with implementations of this disclosure.
Figure 29:
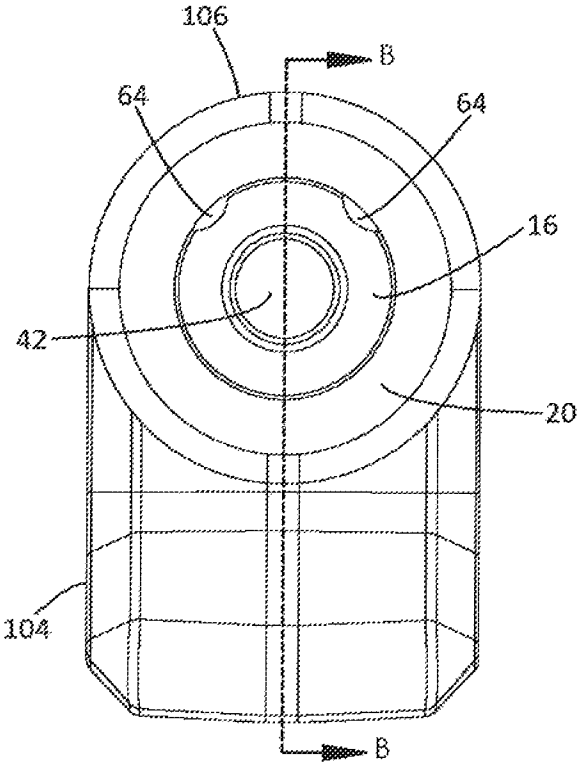
FIG. 29 is a front elevation view of the first embodiment of the bit holder assembled in the first embodiment of the base block in accordance with implementations of this disclosure.
Figure 32:
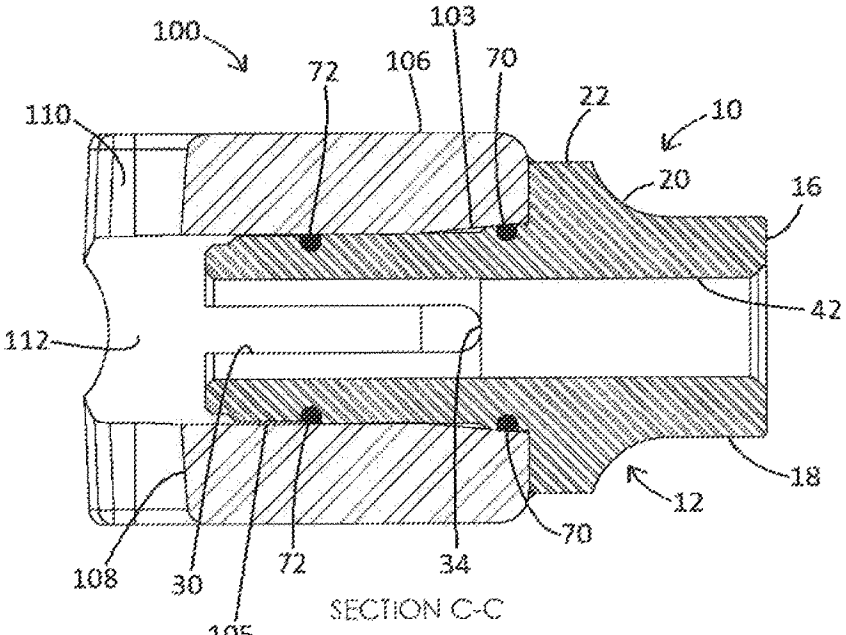
FIG. 32 is a cross-sectional view of the first embodiment of the bit holder, shown with the first embodiment of the two annular rings disposed on the shank of the bit holder, assembled in the first embodiment of the base block, taken along line C-C of FIG. 31, in accordance with implementations of this disclosure.
Figure 31:
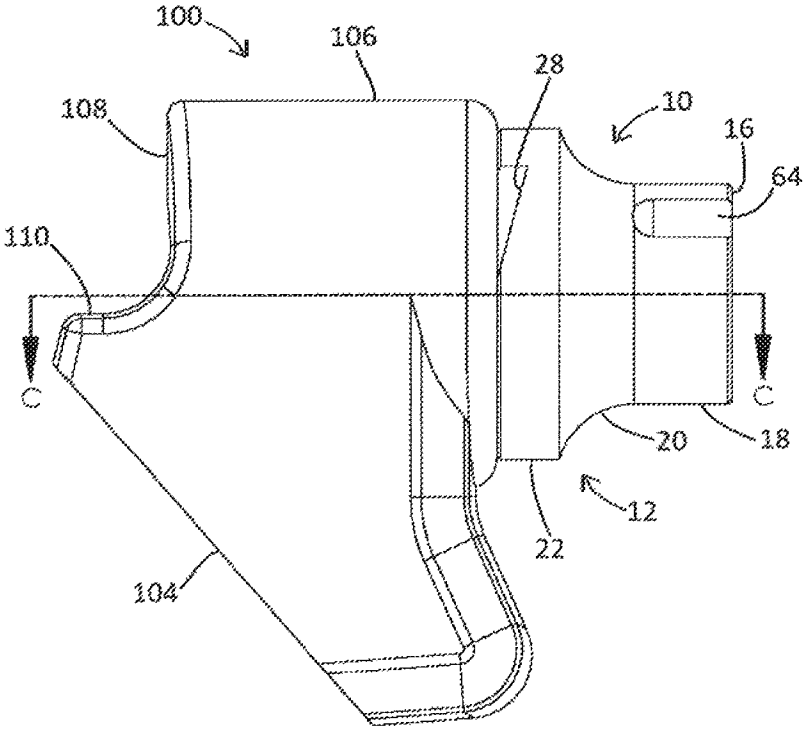
FIG. 31 is a right side elevation view of the first embodiment of the bit holder assembled in the first embodiment of the base block in accordance with implementations of this disclosure.
Figures 37, 38, 39:
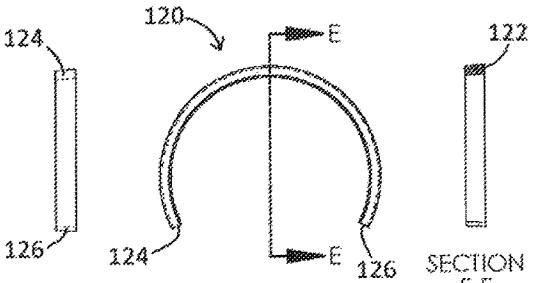
FIG. 37 is a front elevation view of a second embodiment of an annular ring in accordance with implementations of this disclosure.
FIG. 38 is a cross-sectional view of the second embodiment of the annular ring, taken along line E-E of FIG. 37, in accordance with implementations of this disclosure.
FIG. 39 is a rear elevation view of the second embodiment of the annular ring in accordance with implementations of this disclosure.
Figure 40:
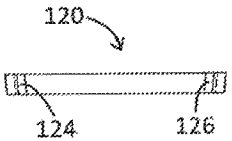
FIG. 40 is a bottom elevation view of the second embodiment of the annular ring in accordance with implementations of this disclosure.
Figures 33, 34, 35:
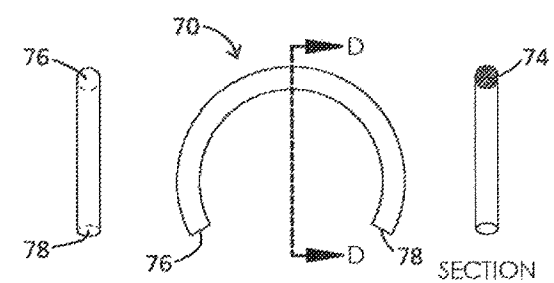
FIG. 33 is a front elevation view of the first embodiment of the annular ring in accordance with implementations of this disclosure.
FIG. 34 is a cross-sectional view of the first embodiment of the annular ring, taken along line D-D of FIG. 33, in accordance with implementations of this disclosure.
FIG. 35 is a rear elevation view of the first embodiment of the annular ring in accordance with implementations of this disclosure.
Figure 36:
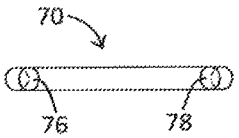
FIG. 36 is a bottom elevation view of the first embodiment of the annular ring in accordance with implementations of this disclosure.
Figures 45, 46, 47:
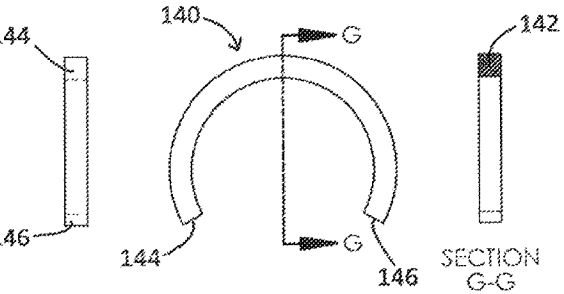
FIG. 45 is a front elevation view of a fourth embodiment of an annular ring in accordance with implementations of this disclosure.
FIG. 46 is a cross-sectional view of the fourth embodiment of the annular ring, taken along line G-G of FIG. 45, in accordance with implementations of this disclosure.
FIG. 47 is a rear elevation view of the fourth embodiment of the annular ring in accordance with implementations of this disclosure.
Figure 48:
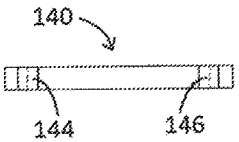
FIG. 48 is a bottom elevation view of the fourth embodiment of the annular ring in accordance with implementations of this disclosure.
Figures 41, 42, 43:
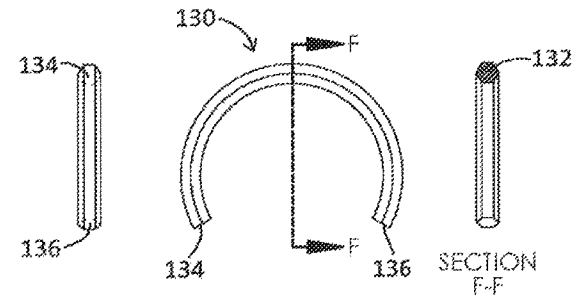
FIG. 41 is a front elevation view of a third embodiment of an annular ring in accordance with implementations of this disclosure.
FIG. 42 is a cross-sectional view of the third embodiment of the annular ring, taken along line F-F of FIG. 41, in accordance with implementations of this disclosure.
FIG. 43 is a rear elevation view of the third embodiment of the annular ring in accordance with implementations of this disclosure.
Figure 44:
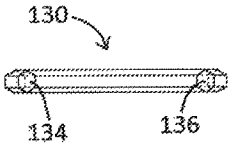
FIG. 44 is a bottom elevation view of the third embodiment of the annular ring in accordance with implementations of this disclosure.
Figures 49, 50, 51:
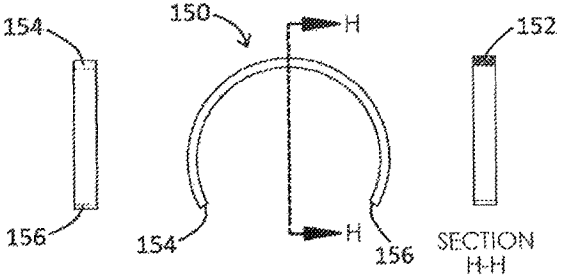
FIG. 49 is a front elevation view of a fifth embodiment of an annular ring in accordance with implementations of this disclosure.
FIG. 50 is a cross-sectional view of the fifth embodiment of the annular ring, taken along line H-H of FIG. 51, in accordance with implementations of this disclosure.
FIG. 51 is a rear elevation view of the fifth embodiment of the annular ring in accordance with implementations of this disclosure.
Figure 52:
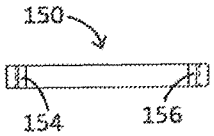
FIG. 52 is a bottom elevation view of the fifth embodiment of the annular ring in accordance with implementations of this disclosure.
Figures 53, 54, 55:
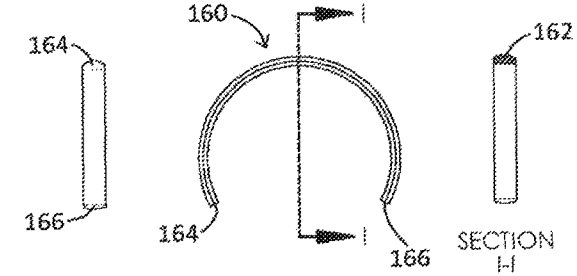
FIG. 53 is a front elevation view of a sixth embodiment of an annular ring in accordance with implementations of this disclosure.
FIG. 54 is a cross-sectional view of the sixth embodiment of the annular ring, taken along line I-I of FIG. 53, in accordance with implementations of this disclosure.
FIG. 55 is a rear elevation view of the sixth embodiment of the annular ring in accordance with implementations of this disclosure.
Figure 56:
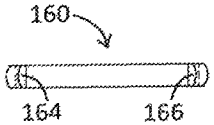
FIG. 56 is a bottom elevation view of the sixth embodiment of the annular ring in accordance with implementations of this disclosure.
Figures 57, 58, 59:
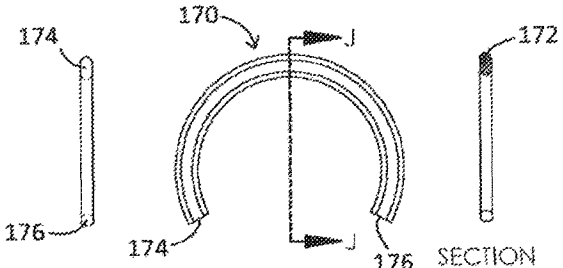
FIG. 57 is a front elevation view of a seventh embodiment of an annular ring in accordance with implementations of this disclosure.
FIG. 58 is a cross-sectional view of the seventh embodiment of the annular ring, taken along line J-J of FIG. 57, in accordance with implementations of this disclosure.
FIG. 59 is a rear elevation view of the seventh embodiment of the annular ring in accordance with implementations of this disclosure.
Figure 60:
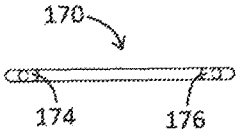
FIG. 60 is a bottom elevation view of the seventh embodiment of the annular ring in accordance with implementations of this disclosure.
Figures 61, 62, 63:
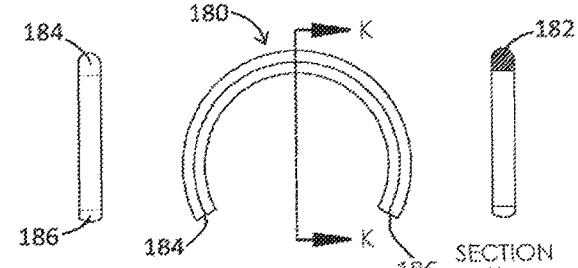
FIG. 61 is a front elevation view of an eighth embodiment of an annular ring in accordance with implementations of this disclosure.
FIG. 62 is a cross-sectional view of the eighth embodiment of the annular ring, taken along line K-K of FIG. 61, in accordance with implementations of this disclosure.
FIG. 63 is a rear elevation view of the eighth embodiment of the annular ring in accordance with implementations of this disclosure.
Figure 64:
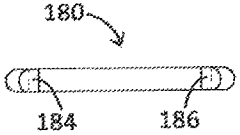
FIG. 64 is a bottom elevation view of the eighth embodiment of the annular ring in accordance with implementations of this disclosure.
Figure 65:
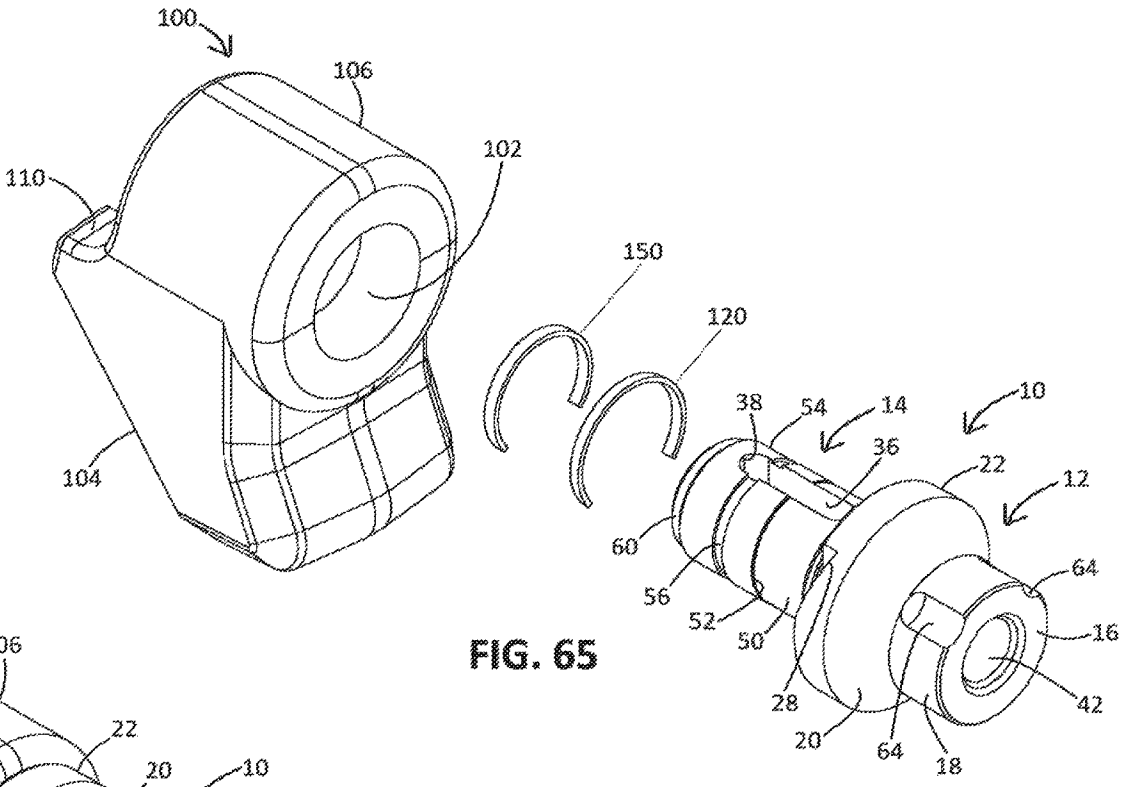
FIG. 65 is an exploded perspective view of the first embodiment of the bit holder, the fifth embodiment of the annular rings, and the first embodiment of the base block, in accordance with implementations of this disclosure.
Figure 66:
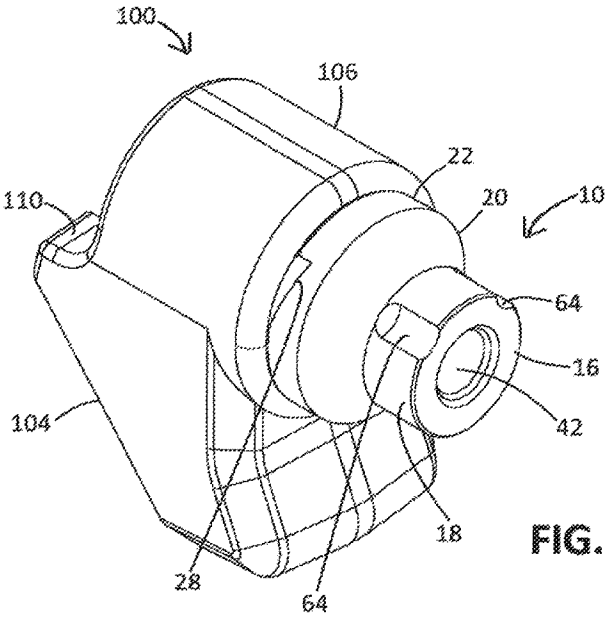
FIG. 66 is a perspective view of the first embodiment of the bit holder assembled in the first embodiment of the base block in accordance with implementations of this disclosure.
Figure 67:
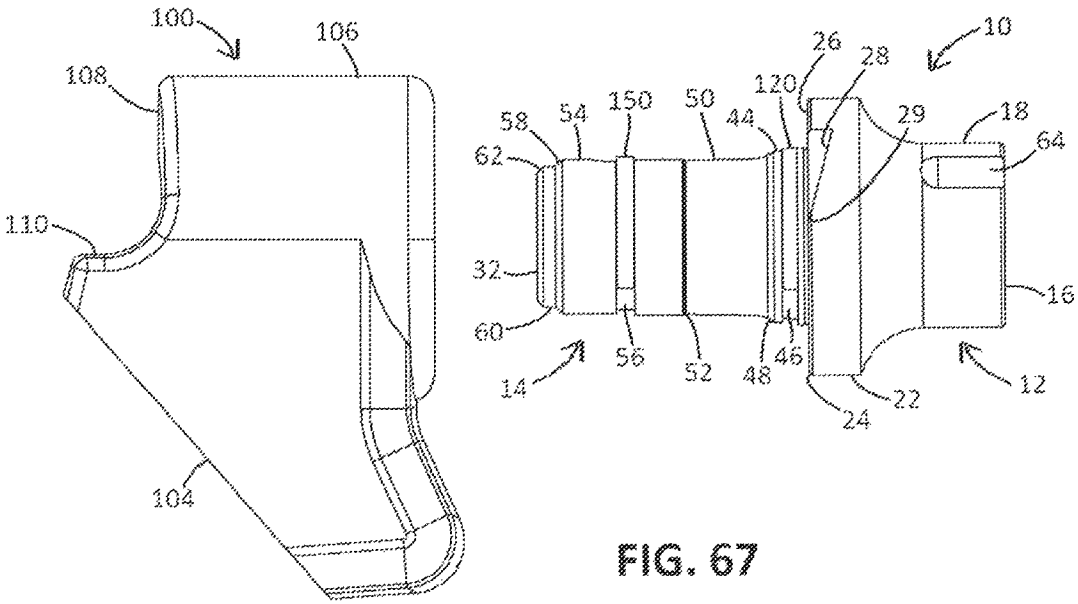
FIG. 67 is an exploded view of the first embodiment of the bit holder, shown with the fifth embodiment of the two annular rings disposed on the shank of the bit holder, and the first embodiment of the base block, in accordance with implementations of this disclosure.
Figure 68:
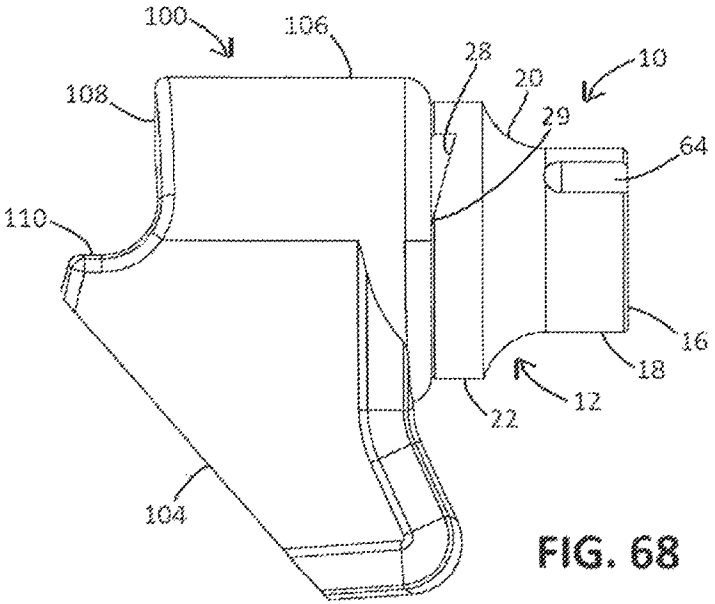
FIG. 68 is right side elevation view of the first embodiment of the bit holder assembled in the first embodiment of the base block in accordance with implementations of this disclosure.

Referring to FIGS. 29-32, the first embodiment of the bit holder 10, with the first embodiment of annular ring 70 disposed around groove 46 of increased diameter first segment 44 and the first embodiment of annular ring 72 disposed around groove 56 of increased diameter third segment 54, is shown assembled in the bore 102 of the first embodiment of the base block 100. When assembled into base block bore 102, the outer diameter of annular rings 70, 72 are slightly flattened and conform to any base block bore diameter, as shown in FIGS. 30 and 32, so that the outer profile of the annular rings 70, 72 match the bore 102 profile of the base block 100. The flattened outer diameter of annular rings 70, 72 adds surface area that provides higher load capacity.

Referring to FIGS. 37-40, a second embodiment of a c-shaped annular ring 120 is shown. In this illustrated exemplary second embodiment, the c-shaped annular ring 120 is a steel angular flat ring, including a rectangular cross-section 122 taken at an angle to a longitudinal axis of the angular flat ring 120, that extends from a first end 124 to a second end 126. The c-shaped angular flat ring 120 includes a planar inner surface and a planar outer surface that tapers inwardly as the outer surface axially extends from a top of the round wire round ring to a distal end adjacent the first end 124 and the second end 126 of the angular flat ring. The outer profile of the annular rings of each embodiment match the base block bore 102 profile.

To assemble the c-shaped annular ring 120 with the bit holder of the first embodiment, a first c-shaped annular ring 120 is disposed around/in groove 46 of the increased diameter tapered first segment 44 and a second c-shaped annular ring 120 of a smaller size or diameter is disposed around/in groove 56 of the increased diameter third segment 54. When disposed around groove 46 and groove 56, the first end 124 and the second end 126 of the annular ring 120 are spatially oriented from each other, in this illustrated embodiment, such that annular ring 120 does not extend completely around the circumference of the shank 14 in groove 46 and/or groove 56. The annular ring 120 includes an exaggerated raised profile that when seated on the groove 56 provides additional interference that will compensate for bore wear in the tapered section 103 and the generally cylindrical section 105, respectively, of bore 102 of the base block 100. The shank 14 of the bit holder 10, including annular rings 120, 120, is inserted into the bore 102 of the base block 100 and forms an added interference fit between the rings seated on the grooves and the bore 102 of the base block 100. Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The purpose of adding the bore wear compensating features, such as annular ring 120 to the bit holder 10 is to provide a base block that has the same lifespan as the lifespan of the drum on which they're mounted, thereby increasing the lifespan of the drum itself.

Referring to FIGS. 41-44, a third embodiment of c-shaped annular ring 130 is shown. In this illustrated exemplary third embodiment, the c-shaped annular ring 130 is a steel hexagonal ring, including a hexagonal cross-section 132 taken at an angle to a longitudinal axis of the hexagonal ring 130, that extends from a first end 134 to a second end 136. The outer profile of the annular rings of each embodiment match the base block bore 102 profile.

To assemble the c-shaped annular ring 130 with the bit holder 10 of the first embodiment, the first c-shaped annular ring 130 is disposed around/in groove 46 of the increased diameter tapered first segment 44 and a second c-shaped annular ring 130 of a smaller size or diameter is disposed around/in groove 56 of the increased diameter third segment 54. When disposed around groove 46 and groove 56, the first end 134 and the second end 136 of the annular ring 130 are spatially oriented from each other, in this illustrated embodiment, such that annular ring 130 does not extend completely around the circumference of the shank 14 in groove 46 and/or groove 56. The annular ring 130 includes an exaggerated raised profile that provides additional interference that will compensate for bore wear in the tapered section 103 and the generally cylindrical section 105, respectively, of bore 102 of the base block 100. The shank 14 of the bit holder 10, including annular rings 130, 130, is inserted into the bore 102 of the based block 100 and forms an interference fit with the bore 102 of the base block 100. Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The purpose of adding the bore wear compensating features, such as annular ring 130 to the bit holder 10 is to provide a base block that has the same lifespan as the lifespan of the drum on which they're mounted, thereby increasing the lifespan of the drum itself.

Referring to FIGS. 45-48, a fourth embodiment of c-shaped annular ring 140 is shown. In this illustrated exemplary fourth embodiment, the c-shaped annular ring 140 is a steel square ring, including a square cross-section 142 taken at an angle to a longitudinal axis of the square ring 140, that extends from a first end 144 to a second end 146. The outer profile of the annular rings of each embodiment match the base block bore 102 profile.

To assemble the c-shaped annular ring 140 with the bit holder 10 of the first embodiment, a first c-shaped annular ring 140 is disposed around/in groove 46 of the increased diameter tapered first segment 44 and a second c-shaped annular ring 140 of a smaller size is disposed around/in groove 56 of the increased diameter third segment 54. When disposed around groove 46 and groove 56, the first end 144 and the second end 146 of the annular ring 140 are spatially oriented from each other, in this illustrated embodiment, such that annular ring 140 does not extend completely around the circumference of the shank 14 in groove 46 and/or groove 56. The annular ring 140 includes an exaggerated raised profile that provides additional interference that will compensate for bore wear in the tapered section 103 and the generally cylindrical section 105, respectively, of bore 102 of the base block 100. The shank 14 of the bit holder 10, including annular rings 140, 140, is inserted into the bore 102 of the base block 100 and forms an interference fit with the bore 102 of the base block 100. Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The purpose of adding the bore wear compensating features, such as annular ring 140 to the bit holder 10 is to provide a base block that has the same lifespan as the lifespan of the drum on which they're mounted, thereby increasing the lifespan of the drum itself.

Referring to FIGS. 49-52, a fifth embodiment of a c-shaped annular ring 150 is shown. In this illustrated exemplary fifth embodiment, the c-shaped annular ring 150 is a steel flat ring, including a rectangular cross-section 152 taken at an angle to a longitudinal axis of the flat ring 150, that extends from a first end 154 to a second end 156. The outer profile of the annular rings of each embodiment match the base block bore 102 profile.

To assemble the c-shaped annular ring 150 with the bit holder 10 of the first embodiment, a first c-shaped annular ring 150 is disposed around/in groove 46 of the increased diameter tapered first segment 44 and a second c-shaped annular ring 150 of a smaller size or diameter is disposed around/in groove 56 of the increased diameter third segment 54. When disposed around groove 46 and groove 56, the first end 154 and the second end 156 of the annular ring 150 are spatially oriented from each other, in this illustrated embodiment, such that annular ring 150 does not extend completely around the circumference of the shank 14 in groove 46 and/or groove 56. The annular ring 150 includes an exaggerated raised profile that provides additional interference that will compensate for bore wear in the tapered section 103 and the generally cylindrical section 105, respectively, of bore 102 of the base block 100. The shank 14 of the bit holder 10, including annular rings 150, 150, is inserted into the bore 102 of the base block 100 and forms an interference fit with the bore 102 of the base block 100. Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The purpose of adding the bore wear compensating features, such as annular ring 150 to the bit holder 10 is to provide a base block that has the same lifespan as the lifespan of the drum on which they're mounted, thereby increasing the lifespan of the drum itself.

Referring to FIGS. 53-56, a sixth embodiment of a c-shaped annular ring 160 is shown. In this illustrated exemplary sixth embodiment, the c-shaped annular ring 160 is a steel semi-flat ring, including a semi-flat cross-section 162 taken at an angle to a longitudinal axis of the semi-flat ring 160, that extends from a first end 164 to a second end 166. This c-shaped annular ring 160 is semi-flat in that the semi-flat ring 160 includes a planar inner surface and an arcuate outer surface. The outer profile of the annular rings of each embodiment match the base block bore 102 profile and the inner surface contacts the groove.

To assemble the c-shaped annular ring 160 with the bit holder 10 of the first embodiment, a first c-shaped annular ring 160 is disposed around/in groove 46 of the increased diameter tapered first segment 44 and a second c-shaped annular ring 160 of a smaller size or diameter is disposed around/in groove 56 of the increased diameter third segment 54. When disposed around groove 46 and groove 56, the first end 164 and the second end 166 of the annular ring 160 are spatially oriented from each other, in this illustrated embodiment, such that annular ring 160 does not extend completely around the circumference of the shank 14 in groove 46 and/or groove 56. The annular ring 160 includes an exaggerated raised profile that provides additional interference that will compensate for bore wear in the tapered section 103 and the generally cylindrical section 105, respectively, of bore 102 of the base block 100. The shank 14 of the bit holder 10, including annular rings 160, 160, is inserted into the bore 102 of the base block 100 and forms an interference fit with the bore 102 of the base block 100. Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The purpose of adding the bore wear compensating features, such as annular ring 160 to the bit holder 10 is to provide a base block that has the same lifespan as the lifespan of the drum on which they're mounted, thereby increasing the lifespan of the drum itself.

Referring to FIGS. 57-60, a seventh embodiment of a c-shaped annular ring 170 is shown. In this illustrated exemplary seventh embodiment, the c-shaped annular ring 170 is a steel oval ring, including an oval cross-section 172 taken at an angle to a longitudinal axis of the oval ring 170 that extends from a first end 174 to a second end 176. The outer profile of the annular rings of each embodiment match the base block bore 102 profile.

To assemble the c-shaped annular ring 170 with the bit holder 10 of the first embodiment, a first c-shaped annular ring 170 is disposed around/in the increased diameter tapered first segment 44 and a second c-shaped annular ring 170 of a smaller size or diameter is disposed around/in the increased diameter third segment 54. When disposed around groove 46 and groove 56, the first end 174 and the second end 176 of the annular ring 170 are spatially oriented from each other, in this illustrated embodiment, such that annular ring 170 does not extend completely around the circumference of the shank 14 in groove 46 and/or groove 56. The annular ring 170 includes an exaggerated raised profile that provides additional interference that will compensate for bore wear in the tapered section 103 and the generally cylindrical section 105, respectively, of bore 102 of the base block 100. The shank 14 of the bit holder 10, including annular rings 170, 170, is inserted into the bore 102 of the base block 100 and forms an interference fit with the bore 102 of the base block 100. Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The purpose of adding the bore wear compensating features, such as annular ring 170 to the bit holder 10 is to provide a base block that has the same lifespan as the lifespan of the drum on which they're mounted, thereby increasing the lifespan of the drum itself.

Referring to FIGS. 61-64, an eighth embodiment of a c-shaped annular ring 180 is shown. In this illustrated exemplary eighth embodiment, the c-shaped annular ring 180 is a steel semi-oval ring, including a semi-oval cross-section 182 taken at an angle to a longitudinal axis of the semi-oval ring 180, that extends from a first end 184 to a second end 186. This c-shaped annular ring 180 is semi-oval in that the semi-oval ring 180 includes a planar inner surface and an arcuate or half-oval outer surface. The outer profile of the annular rings of each embodiment match the base block bore 102 profile and the inner surface contacts the groove.

To assemble the c-shaped annular ring 180 with the bit holder 10 of the first embodiment, a first c-shaped annular ring 180 is disposed around/in groove 46 of the increased diameter tapered first segment 44 and a second c-shaped annular ring 180 of a smaller size or diameter is disposed around/in the increased diameter third segment 54. When disposed around groove 46 and groove 56, the first end 184 and the second end 186 of the annular ring 180 are spatially oriented from each other, in this illustrated embodiment, such that annular ring 180 does not extend completely around the circumference of the shank 14 in groove 46 and/or groove 56. The annular ring 180 includes an exaggerated raised profile that provides additional interference that will compensate for bore wear in the tapered section 103 and the generally cylindrical section 105, respectively, of bore 102 of the base block 100. The shank 14 of the bit holder 10, including annular rings 180, 180, is inserted into the bore 102 of the base block 100 and forms an added interference fit with the bore 102 of the base block 100. Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The purpose of adding the bore wear compensating features, such as annular ring 180 to the bit holder 10 is to provide a base block that has the same lifespan as the lifespan of the drum on which they're mounted, thereby increasing the lifespan of the drum itself.

In other embodiments, the annular rings can also include a fully or partially circular elastomer rings, such as polytetrafluoroethylene (Teflon), acrylonitrile butadiene rubber (NBR) or nitrile rubber, also know as Buna-N, silicone, etc., that have a sufficient radial strength to withstand the radial forces generated while in use. An example of use of elastomer rings is for smaller equipment with less horsepower that would not require the radial strength of a metal ring.

It is to be understood that while the first embodiment of annular round wire round rings 70, 72 were used in grooves 46, 56, respectively, of shank 14 of bit holder 10 in FIGS. 7-14-17, 22, 25, 26, 30, and 32, groove 46 and groove 56 of shank 14 of bit holder 10 can accept any variation and/or combination of annular rings, such as annular rings 70, 72, 120, 130, 140, 150, 160, 170, and 180 for example, that form an interference fit with the bore 102 of the base block 100. The annular rings can be partially or nearly circumferentially disposed around the shank and/or can be up to 259 degrees in circumference.

Figure 70:
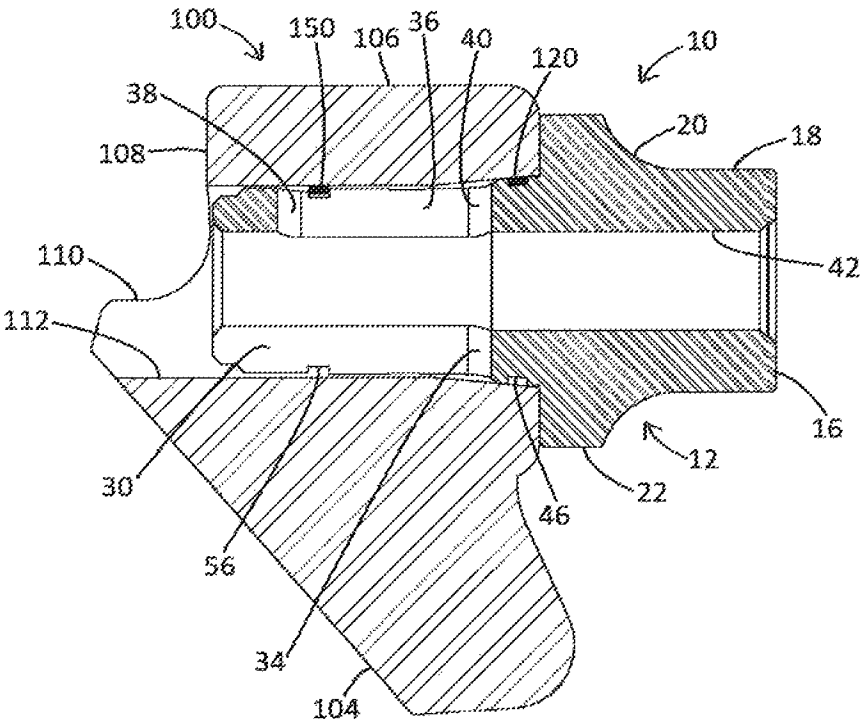
FIG. 70 is a cross-sectional view of the first embodiment of the bit holder, shown with the fifth embodiment of the two annular rings disposed on the shank of the bit holder, assembled in the first embodiment of the base block, taken along line L-L of FIG. 69, in accordance with implementations of this disclosure.
Figure 69:
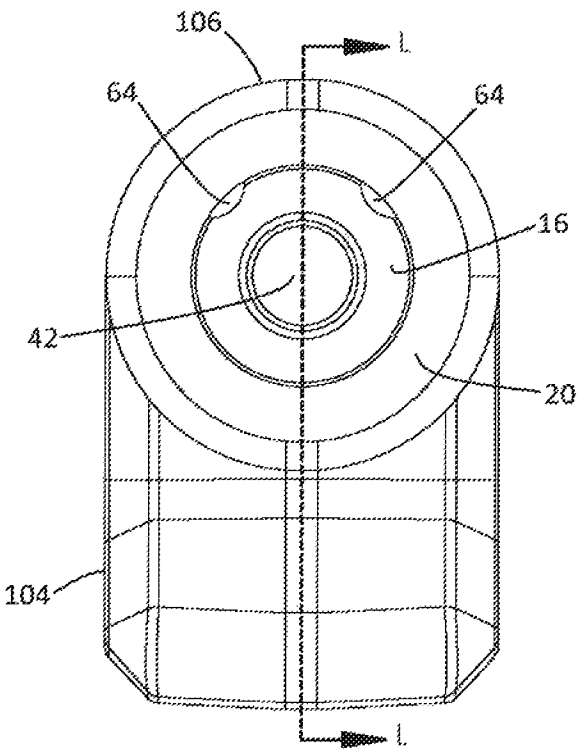
FIG. 69 is a front elevation view of the first embodiment of the bit holder assembled in the first embodiment of the base block in accordance with implementations of this disclosure.
Figure 72:
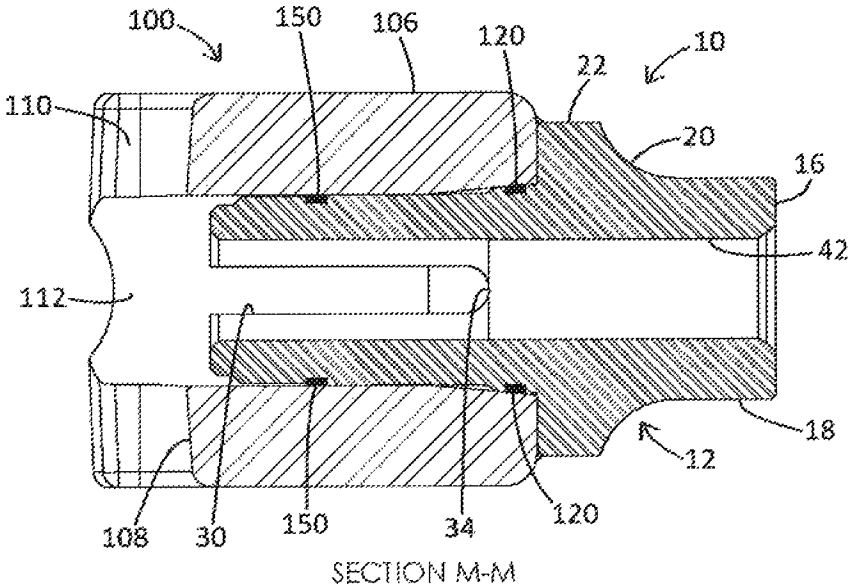
FIG. 72 is a cross-sectional view of the first embodiment of the bit holder, shown with the fifth embodiment of the two annular rings disposed on the shank of the bit holder, assembled in the first embodiment of the base block, taken along line M-M of FIG. 71, in accordance with implementations of this disclosure.
Figure 71:
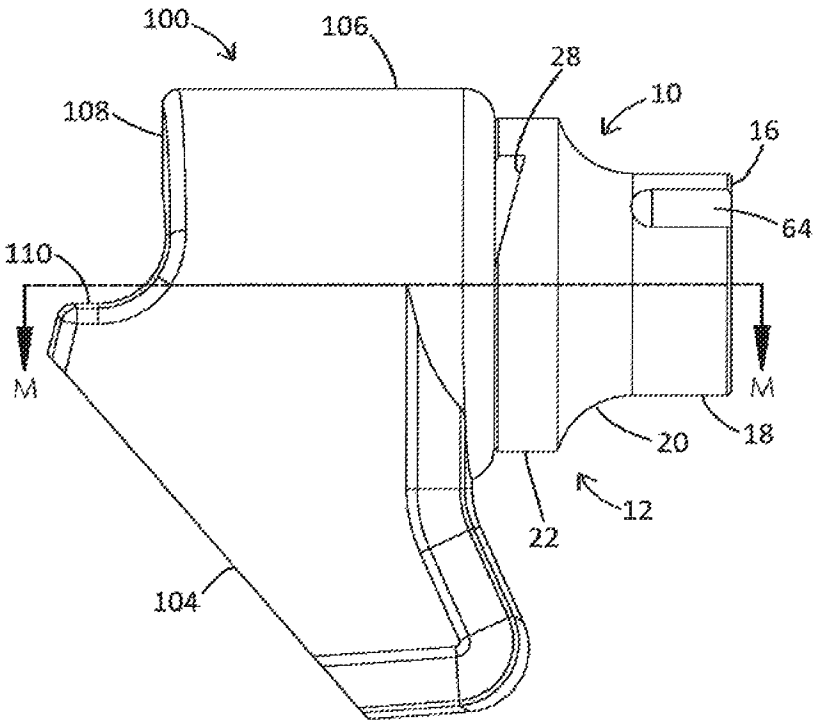
FIG. 71 is a right side elevation view of the first embodiment of the bit holder assembled in the first embodiment of the base block in accordance with implementations of this disclosure.

For example, referring to FIGS. 65-72, the first embodiment of the bit holder 10, with the second embodiment of annular angular flat ring 120 disposed around groove 46 of increased diameter first segment 44 and the fifth embodiment of annular flat ring 150 disposed around groove 56 of increased diameter third segment 54, is shown assembled in the bore 102 of the first embodiment of the base block 100. Groove 46 and groove 56 include the same profile seat, or inner diameter, for the bottom portion of the groove 46, 56 as the inner diameter of the ring 120, 150, respectively. When assembled into base block bore 102, the outer diameter of annular rings 120, 150 are flattened and conform to any base block bore diameter, as shown in FIGS. 70 and 72, so that the outer profile of the annular rings 120, 150 match the tapered section 103 and generally cylindrical section 105 of bore 102 profile of the base block 100. The flattened outer diameter of annular rings 120, 150 adds surface area that provides higher load capacity.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the present disclosure is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder comprising:

a body portion;

a generally cylindrical hollow shank axially depending from a bottom of the body portion, the shank comprising:

a forward portion of the shank adjacent the bottom of the body portion, the forward portion comprising an outer diameter including one of a declining taper outer surface towards a distal end of the shank and a generally cylindrical outer surface, the forward portion including a first annular groove positioned circumferentially around the forward portion approximately midway between a forward end of the forward portion and a distal end of the forward portion;

a distal portion of the shank comprising an outer diameter including an outer surface, the distal portion including a second annular groove therearound;

an elongate slot through a side wall of said hollow shank axially extending from the distal end of the shank to the forward portion adjacent the first annular groove, the elongate slot comprising an upper termination adjacent said forward portion;

a first c-shaped annular ring disposed in the first annular groove;

a second c-shaped annular ring disposed in the second annular groove an outer diameter of said first annular ring being larger than the outer diameter of said forward portion of the shank;

an outer diameter of said second annular ring being larger than the outer diameter of said distal portion; and a bore axially extending from a forward end of the body portion to the distal end of the shank.

2. The bit holder of claim 1, further comprising:

a tire portion of the body portion upwardly adjacent the bottom of the body portion, the tire portion comprising a first pair of spatially positioned parallel undercuts extending into the tire portion from the bottom of the body portion, the undercuts being a hollow wedge shape, each undercut comprising a declining terminus that at least one of ends short of a plane through a longitudinal axis of the body portion, ends at the plane through the longitudinal axis of the body portion, ends past the plane through the longitudinal axis of the body portion, and is offset from the declining terminus of an adjacent undercut.

3. The bit holder of claim 2, the tire portion further comprises a radially inward outer annular tapered portion adjacent the bottom of the body portion.

4. The bit holder of claim 1, the first c-shaped annular ring comprising at least one of:

a first ring comprising a round first cross-section taken at an angle to a first longitudinal axis of the first ring;

a second ring comprising a rectangular second cross-section taken at an angle to a second longitudinal axis of the second ring, a second planar inner surface, and a second planar outer surface that tapers inwardly as the second planar outer surface axially extends from a first side of the second ring to a second side of the second ring;

a hexagonal third ring comprising a hexagonal third cross-section taken at an angle to a third longitudinal axis of the third ring;

a square fourth ring comprising a square fourth cross-section taken at an angle to a fourth longitudinal axis of the fourth ring;

a flat fifth ring comprising a rectangular fifth cross-section taken at an angle to a fifth longitudinal axis of the fifth ring, a fifth planar inner surface, and a fifth planar outer surface;

a semi-flat sixth ring comprising a sixth planar inner surface and a sixth arcuate outer surface;

a seventh ring comprising an oval seventh cross-section taken at an angle to a seventh longitudinal axis of the seventh ring; and an eighth ring comprising an eighth planar inner surface and an eighth arcuate outer surface.

5. The bit holder of claim 1, the second c-shaped annular ring comprising at least one of:

a first ring comprising a round first cross-section taken at an angle to a first longitudinal axis of the first ring;

a second ring comprising a rectangular second cross-section taken at an angle to a second longitudinal axis of the second ring, a second planar inner surface, and a second planar outer surface that tapers inwardly as the second planar outer surface axially extends from a first side of the second ring to a second side of the second ring;

a third ring comprising hexagonal third cross-section taken at an angle to a third longitudinal axis of the third ring;

a fourth ring comprising a square fourth cross-section taken at an angle to a fourth longitudinal axis of the fourth ring;

a fifth ring comprising a rectangular fifth cross-section taken at an angle to a fifth longitudinal axis of the fifth ring, a fifth planar inner surface, and a fifth planar outer surface;

a sixth ring comprising a sixth planar inner surface and a sixth arcuate outer surface;

a sixth ring comprising an oval sixth cross-section taken at an angle to a sixth longitudinal axis of the sixth ring; and an eighth ring comprising an eighth planar inner surface and an eighth arcuate outer surface.

6. The bit holder of claim 1, further comprising:

an internal slot of the shank axially extending from a rearward termination adjacent the distal end of the shank to a forward termination adjacent the bottom of the body portion.

7. The bit holder of claim 1, further comprising:

a first end and a second end of the first c-shaped annular ring, the first end of the first c-shaped annular ring being spatially positioned from the second end of the first c-shaped annular ring; and a first end and a second end of the second c-shaped annular ring, the first end of the second c-shaped annular ring being spatially positioned from the second end of the second c-shaped annular ring.

8. The bit holder of claim 1, the first c-shaped annular ring comprising one of a round wire ring, a steel ring, an elastomer ring, a polytetrafluoroethylene ring, an acrylonitrile butadiene rubber ring, a nitrile rubber ring, and a silicone ring and the second c-shaped annular ring comprising one of a round wire ring, a steel ring, an elastomer ring, a polytetrafluoroethylene ring, an acrylonitrile butadiene rubber ring, a nitrile rubber ring, and a silicone ring.

9. The bit holder of claim 1, the distal portion of said shank comprising one of an outer generally cylindrical surface, an outer declining taper surface toward the distal end of the shank, and an outer increasing taper surface toward the distal end of the shank.

10. The bit holder of claim 1, at least a part of the distal portion of said shank comprising a cylindrical surface adjacent the distal end of the shank.

11. The bit holder of claim 1, further comprising:

a distal reverse taper surface toward the distal end of said shank.

12. The bit holder of claim 1, the outer diameter of said forward portion of said shank being larger than the diameter of said distal portion of said shank.

13. The bit holder of claim 1, said first C-shaped annular ring being larger than said second C-shaped annular ring.

14. The bit holder of claim 1, both said first and second C-shaped annular rings seating in their first and second annular grooves, respectively.

15. A combination bit holder and base block comprising:

a base block comprising:

a base mounting portion including a base surface; and a device receiving portion integrally extending from the base mounting portion opposite the base surface, the device receiving portion comprising a base block bore extending from a front face of the device receiving portion to a rear face of the device receiving portion; and a bit holder comprising:

a body portion; and a generally cylindrical hollow shank axially depending from a bottom of the body portion, the shank comprising:

a forward portion of the shank adjacent the bottom of the body portion, the forward portion comprising an outer diameter sized for a non-rotatable interference fit with said base block bore including one of a declining taper outer surface towards a distal end of the shank and a generally cylindrical outer surface, the forward portion including a first annular groove positioned circumferentially around the forward portion approximately midway between a forward end of the forward portion and a distal end of the forward portion;

a distal portion of the shank comprising an outer diameter including an outer surface that is sized for an interference fit with said base block bore, the distal portion including a second annular groove therearound;

an elongate slot through a side wall of said hollow shank axially extending from the distal end of the shank to the forward portion adjacent the first annular groove, the elongate slot comprising an upper termination adjacent said forward portion;

a first c-shaped annular ring disposed in the first annular groove;

a second c-shaped annular ring disposed in the second annular groove;

an outer diameter of said first annular ring being larger than the outer diameter of said forward portion of the shank, providing added interference between said forward portion and said base block bore;

an outer diameter of said second annular ring being larger than the outer diameter of said distal portion, providing added interference between said distal portion and said base block bore; and a bit holder bore axially extending from a forward end of the body portion to the distal end of the shank.

16. The combination bit holder and base block of claim 15, further comprising:

a tire portion of the body portion upwardly adjacent the bottom of the body portion, the tire portion comprising a first pair of spatially positioned parallel undercuts extending into the tire portion from the bottom of the body portion, the undercuts being a hollow wedge shape, each undercut comprising a declining terminus that at least one of ends short of a plane through a longitudinal axis of the body portion, ends at the plane through the longitudinal axis of the body portion, ends past the plane through the longitudinal axis of the body portion, and is offset from the declining terminus of an adjacent undercut.

17. The combination bit holder and base block of claim 16, the tire portion further comprises a radially inward outer annular tapered portion adjacent the bottom of the body portion.

18. The combination bit holder and base block of claim 15, the first c-shaped annular ring comprising at least one of:

a first ring comprising a round first cross-section taken at an angle to a first longitudinal axis of the first ring;

a second ring comprising a rectangular second cross-section taken at an angle to a second longitudinal axis of the second ring, a second planar inner surface, and a second planar outer surface that tapers inwardly as the second planar outer surface axially extends from a first side of the second ring to a second side of the second ring;

a third ring comprising a hexagonal third cross-section taken at an angle to a third longitudinal axis of the third ring;

a fourth ring comprising a square fourth cross-section taken at an angle to a fourth longitudinal axis of the fourth ring;

a fifth ring comprising a rectangular fifth cross-section taken at an angle to a fifth longitudinal axis of the fifth ring, a fifth planar inner surface, and a fifth planar outer surface;

a sixth ring comprising a sixth planar inner surface and a sixth arcuate outer surface;

a seventh ring comprising an oval seventh cross-section taken at an angle to a seventh longitudinal axis of the seventh ring; and a ring comprising an eighth planar inner surface and an eighth arcuate outer surface.

19. The combination bit holder and base block of claim 15, the second c-shaped annular ring comprising at least one of:

a first ring comprising a round first cross-section taken at an angle to a first longitudinal axis of the first ring;

a second ring comprising a rectangular second cross-section taken at an angle to a second longitudinal axis of the second ring, a second planar inner surface, and a second planar outer surface that tapers inwardly as the second planar outer surface axially extends from a first side of the angular flat ring to a second side of the second ring;

a third ring comprising a hexagonal third cross-section taken at an angle to a third longitudinal axis of the third ring;

a fourth ring comprising a square fourth cross-section taken at an angle to a fourth longitudinal axis of the fourth ring;

a fifth ring comprising a rectangular fifth cross-section taken at an angle to a fifth longitudinal axis of the fifth ring, a fifth planar inner surface, and a fifth planar outer surface;

a sixth ring comprising a sixth planar inner surface and a sixth arcuate outer surface;

a seventh ring comprising an oval seventh cross-section taken at an angle to a seventh longitudinal axis of the seventh ring; and an eighth ring comprising an eighth planar inner surface and an eighth arcuate outer surface.

20. The combination bit holder and base block of claim 15, further comprising:

an internal slot of the shank axially extending from a rearward termination adjacent the distal end of the shank to a forward termination adjacent the bottom of the body portion.

21. The combination bit holder and base block of claim 15, further comprising:

a first end and a second end of the first c-shaped annular ring, the first end of the first c-shaped annular ring being spatially positioned from the second end of the first c-shaped annular ring; and a first end and a second end of the second c-shaped annular ring, the first end of the second c-shaped annular ring being spatially positioned from the second end of the second c-shaped annular ring.

22. The combination bit holder and base block of claim 15, further comprising:

an extension of an arcuate segment of the base block bore, the extension extending past the rear face of the device receiving portion and onto a surface of the base mounting portion, the surface of the base mounting portion axially extending from the rear face of the device receiving portion.

23. The combination bit holder and base block of claim 15, further comprising:

an angular slot extending inwardly from the rear face of the device receiving portion, the angular slot enclosed within a sidewall of the device receiving portion and decreasing in size from the rear face of the device receiving portion to a position mediate the front face of the device receiving portion and the rear face of the device receiving portion, a distal end of the angular slot positioned mediate an inner diameter of the devise receiving portion and an outer diameter of the device receiving portion.

24. The combination bit holder and base block of claim 15, the first c-shaped annular ring comprising one of a round wire ring, a steel ring, an elastomer ring, a polytetrafluoroethylene ring, an acrylonitrile butadiene rubber ring, a nitrile rubber ring, and a silicone ring and the second c-shaped annular ring comprising one of a round wire ring, a steel ring, an elastomer ring, a polytetrafluoroethylene ring, an acrylonitrile butadiene rubber ring, a nitrile rubber ring, and a silicone ring.

25. The combination bit holder and base block of claim 15, further comprising:

a tapered section of the base block bore adjacent a front face of the device receiving portion; and a generally cylindrical section of the base block bore adjacent the tapered section of the base block bore.

26. The bit holder of claim 15, the distal portion of said shank comprising one of an outer generally cylindrical surface, an outer declining taper surface toward the distal end of the shank, and an outer increasing taper surface toward the distal end of the shank.

27. The bit holder of claim 15, at least a part of the distal portion of said shank comprising a cylindrical surface adjacent the distal end of the shank.

28. The bit holder of claim 15, further comprising:

a distal reverse taper surface toward the distal end of said shank.

29. The bit holder of claim 15, the outer diameter of said forward portion of said shank being larger than the diameter of said distal portion of said shank.

30. The bit holder of claim 15, said first C-shaped annular ring being larger than said second C-shaped annular ring.

31. The bit holder of claim 15, further comprising:

an inside surface of both said first and second C-shaped annular rings contacting their first and second annular grooves, respectively.

* * * * *